US009706296B2

(12) United States Patent
Uhle et al.

(10) Patent No.: US 9,706,296 B2
(45) Date of Patent: Jul. 11, 2017

(54) APPARATUS AND METHOD FOR IMPROVING THE PERCEIVED QUALITY OF SOUND REPRODUCTION BY COMBINING ACTIVE NOISE CANCELLATION AND A PERCEPTUAL NOISE COMPENSATION

(71) Applicant: Fraunhofer-Gesellschaft zur Foerderung der angewandten Forschung e.V., Munich (DE)

(72) Inventors: Christian Uhle, Nuremberg (DE); Juergen Herre, Buckenhof (DE); Andreas Walther, Crissier (CH); Felix Fleischmann, Stein (DE); Patrick Gampp, Erlangen (DE)

(73) Assignee: FRAUNHOFER-GESELLSCHAFT ZUR FOERDERUNG DER ANGEWANDTEN FORSCHUNG E.V., Munich (DE)

( * ) Notice: Subject to any disclaimer, the term of this patent is extended or adjusted under 35 U.S.C. 154(b) by 113 days.

(21) Appl. No.: 14/488,478

(22) Filed: Sep. 17, 2014

(65) Prior Publication Data

US 2015/0003625 A1 Jan. 1, 2015

Related U.S. Application Data

(63) Continuation of application No. PCT/EP2013/056314, filed on Mar. 25, 2013.
(Continued)

(30) Foreign Application Priority Data

May 25, 2012 (EP) ..... 12169608

(51) Int. Cl.
*H04R 3/00* (2006.01)
*G10K 11/178* (2006.01)

(52) U.S. Cl.
CPC ..... *H04R 3/002* (2013.01); *G10K 11/178* (2013.01); *G10K 2210/1081* (2013.01);
(Continued)

(58) Field of Classification Search
CPC ..... H04R 3/00; H04R 3/002; H04R 2460/01; G10K 11/178; G10K 2210/1081; G10K 2210/3014; G10K 2210/509
(Continued)

(56) References Cited

U.S. PATENT DOCUMENTS 6,118,878 A 9/2000 Jones
2006/0262938 A1 11/2006 Gauger, Jr. et al.
(Continued)

FOREIGN PATENT DOCUMENTS

EP 1 770 685 A1 4/2007
EP 2 284 831 A1 2/2011
(Continued)

OTHER PUBLICATIONS

Elliott, S. et al.; "Active Noise Control"; IEEE Signal Processing Magazine; Oct. 1993, pp. 12-35.
(Continued)

*Primary Examiner* — Melur Ramakrishnaiah
(74) *Attorney, Agent, or Firm* — Keating & Bennett, LLP

(57) ABSTRACT

An apparatus for improving a perceived quality of sound reproduction of an audio output signal is provided. The apparatus has an active noise cancellation unit for generating a noise cancellation signal based on an environmental audio signal, wherein the environmental audio signal has noise signal portions, the noise signal portions resulting from recording environmental noise. Moreover, the apparatus has a residual noise characteristics estimator for determining a residual noise characteristic depending on the environmental noise and the noise cancellation signal. Furthermore, the
(Continued)

apparatus has a perceptual noise compensation unit for generating a noise-compensated signal based on an audio target signal and based on the residual noise characteristic. Moreover, the apparatus has a combiner for combining the noise cancellation signal and the noise-compensated signal to obtain the audio output signal.

17 Claims, 23 Drawing Sheets

Related U.S. Application Data

(60) Provisional application No. 61/615,446, filed on Mar. 26, 2012.

(52) U.S. Cl.
CPC ..... *G10K 2210/3014* (2013.01); *G10K 2210/509* (2013.01); *H04R 2460/01* (2013.01)

(58) Field of Classification Search
USPC .... 381/71.6, 71.11, 71.12, 71.14, 71.1, 71.8, 381/94.1
See application file for complete search history.

(56) References Cited

U.S. PATENT DOCUMENTS

| | | | | |
|---|---|---|---|---|
| 2008/0269926 | A1* | 10/2008 | Xiang | H03G 3/32 700/94 |
| 2009/0074199 | A1 | 3/2009 | Kierstein et al. | |
| 2009/0310793 | A1 | 12/2009 | Ohkuri et al. | |
| 2011/0293103 | A1* | 12/2011 | Park | G10K 11/1782 381/57 |
| 2012/0155667 | A1* | 6/2012 | Nair | G10K 11/178 381/71.6 |
| 2012/0170766 | A1* | 7/2012 | Alves | G10K 11/1784 381/71.11 |
| 2013/0083939 | A1* | 4/2013 | Fellers | G10K 11/178 381/71.11 |

FOREIGN PATENT DOCUMENTS

| | | | |
|---|---|---|---|
| JP | 06-012088 | A | 1/1994 |
| JP | 2008-546003 | A | 12/2008 |
| JP | 2009-510534 | A | 3/2009 |
| JP | 2009-302991 | A | 12/2009 |
| JP | 2013-532308 | A | 8/2013 |
| SU | 349011 | A1 | 8/1972 |
| WO | 95/00946 | A1 | 1/1995 |
| WO | 2011/161487 | A1 | 12/2011 |

OTHER PUBLICATIONS

House, W. N.; "Aspects of the Vehicle Listening Environment"; Proceedings of the AES 87th Convention; Oct. 18-21, 1989; 29 pages.

Christoph, M.; "Dynamic Sound Control Algorithms in Automobiles"; Speech and Audio Processing in Adverse Environments; 2008; pp. 615-678.

Kuo, S. et al.; "Active Noise Control System for Headphone Applications"; IEEE Transactions on Control Systems Technology; vol. 14; No. 2; Mar. 2006; pp. 331-335.

Seefeldt, A.; "Loudness Domain Signal Processing"; Proceedings of the AES 123rd Convention; Oct. 5-8, 2007; pp. 1-15.

Moore, B., et al.; "A Model for the Prediction of Thresholds, Loudness, and Partial Loudness"; J. Audio Engineering Society; vol. 45; No. 4; Apr. 1997; pp. 224-240.

Glasberg, B., et al.; "Development and Evaluatioin of a Model for Predicting the Audibility of Time-Varying Sounds in the Presence of Background Sounds"; J. Audio Engineering Society; vol. 53; No. 10; Oct. 2005; pp. 906-918.

Suzuki, Y.; "Precise and Full-range Determination of Two-dimensional Equal Loudness Contours"; Technical Report; AIST; 2003; 10 pages.

English Translation of Official Communication issued in corresponding Russian Patent Application No. 2014143021, mailed on Feb. 4, 2016.

Official Communication issued in corresponding Russian Application No. 2014143021, mailed on Sep. 23, 2016.

* cited by examiner

APPARATUS AND METHOD FOR IMPROVING THE PERCEIVED QUALITY OF SOUND REPRODUCTION BY COMBINING ACTIVE NOISE CANCELLATION AND A PERCEPTUAL NOISE COMPENSATION

CROSS-REFERENCE TO RELATED APPLICATIONS

This application is a continuation of copending International Application No. PCT/EP2013/056314, filed Mar. 25, 2013, which is incorporated herein by reference in its entirety, and additionally claims priority from U.S. Provisional Application No. 61/615,446, filed Mar. 26, 2012, and from European Application No. 12169608.2, filed May 25, 2012, which are also incorporated herein by reference in their entirety.

BACKGROUND OF THE INVENTION

The present invention relates to audio signal processing and, in particular, to an apparatus and method for improving the perceived quality of sound reproduction by combining Active Noise Cancellation and Perceptual Noise Compensation, e.g., by improving the perceived quality of reproduction of sound over headphones.

Audio signal processing becomes more and more important. In many listening scenarios, e.g., in a cabin of a vehicle, the audio signals are presented in a noisy environment and thereby, their sound quality and intelligibility is affected. One approach to reduce the impact of environmental noise on the listening experience is Active Noise Cancellation (Active Noise Control) see, e.g., [1], [2]. ANC (ANC=Active Noise Cancellation) reduces the interfering noise at the receiver side to varying degree. In general, low-frequency noise components can be canceled more successfully than high-frequency components, and stationary noise can be canceled better than non-stationary, and pure tone better than random noise.

Active Noise Cancellation is a technique to suppress acoustic noise based on the principle of acoustic interference. The basic idea of canceling the interfering noise by using a phase-inverted copy of it has first been described in Paul Lueg's patent in 1936, see [7].

The principles of ANC are summarized in [1] and [2]. The sound field emitted by the noise source (primary source) is measured using a transducer. This reference signal is used to generate a secondary signal which is fed into a secondary loudspeaker. If the acoustic wave emitted by the secondary source (the so-called "anti-noise") is exactly out of phase with the acoustic wave of the noise, the noise is canceled due to destructive interference in the region behind the loudspeaker and opposite the noise source, the "zone of quiet". Ideally, plane wave transducers are used for both, microphone and loudspeaker.

Although the anti-noise can be generated by delaying and scaling the measurement of the primary noise, the anti-noise is often computed adaptively to cope with possible variations in the acoustic path between noise and anti-sound transducer. Such implementations are based on adaptive filters whose filter coefficients are computed by minimizing an error signal using the Least-Mean Square (LMS), filtered-X LMS algorithm (FXLMS), leaky FXLMS or other optimization algorithms.

ANC can be implemented as either feedforward control or feedback control.

FIG. 3 illustrates a block diagram of an ANC implementation with feedforward structure. A noise source 310 emits primary noise 320. The primary noise 320 is recorded by a reference microphone 330 as an environmental audio signal d(t). The environmental audio signal is fed into an adaptive filter 340. The adaptive filter is configured to filter the environmental audio signal d(t) to obtain a filtered signal. The filtered signal is employed to steer a loudspeaker 350.

As already stated, the structure illustrated by FIG. 3 is a feedforward structure. In a feedforward structure, the referenced microphone may, e.g., be placed such that the primary noise is picked up before it reaches the secondary source, as shown in FIG. 3.

Often, a second microphone is mounted after the secondary source to measure the residual noise signal. In such a structure, the second microphone represents a residual noise microphone or an error microphone. Such a structure is shown in FIG. 4.

FIG. 4 illustrates a block diagram of an ANC implementation with feedforward structure with an additional error microphone 460. An adaptive algorithm computes the filter coefficients for generating the anti-noise using the referenced microphone signal such that the residual noise is minimized.

FIG. 5 illustrates a block diagram of an ANC implementation with feedback structure. Implementations in feedback structures, as shown in FIG. 5 use only one microphone for measuring the error and generating the secondary signal. A feedback ANC system for headphone application is described in [8].

The effect of the cancellation depends on the accuracy of the superposition of the sound fields of the noise source and the secondary source. In practice, the interfering noise signal is not removed completely. ANC is especially suitable for low-frequency noise signal components and stationary signals, but fails to remove high-frequency and non-stationary noise signal components.

Perceptual Noise Compensation (PNC) is a signal processing method to compensate for the perceptual effects of interfering noise by using psychoacoustic knowledge. The basic principle behind PNC is to apply time-varying equalization such that spectral components of the input audio signal are amplified which are masked by the interfering noise. The main idea has been referred to as e.g. Noise Compensation, see, e.g., [3], Masking Compensation, see, e.g., [4], Sound Equalization in Noisy Environments, see, e.g., [5], or Dynamic Sound Control, see, e.g., [6].

Perceptual Noise Compensation processes an audio signal such that its timbre and loudness, when presented in environmental noise, is perceived as similar or close to those when presented unprocessed in quiet. The additive noise leads to a decrease of the loudness of the desired signal due to partial or total masking effects. The resulting sensation is known as partial loudness. Due to the frequency selective processing in the human auditory system, the interfering noise effects the perceived spectral balance of the desired signal and thereby its timbre.

The basic principles of PNC have been applied, e.g. in [3]. Recent developments have, for example, been described in [9], [10], [11] and [6]. The rationale of the method is to apply time-varying spectral weighting factors to the desired signal such that the sensation of loudness and timbre is restored.

The spectral weighting method of the PNC splits the input audio signal into M frequency bands, advantageously according to a perceptually motivated frequency scale, having the bandwidth of a critical band, e.g. the Bark or ERB scale. The derived sub-band signals $s_m[k]$ are scaled with time-varying gain factors $g_m[k]$, with sub-band index m=1 . . . M and time index k. The gains are computed such that the partial specific loudness N', e.g., the loudness evoked at each auditory frequency band, of the processed signal in noise are equivalent to the specific loudness of the unprocessed audio signal in quiet or a fraction β thereof, as shown in Equation (1), with $e_m[k]$ being the sub-band signals of the additive noise:

$$\beta N'_q[m,k]=N'_p[m,k] \tag{1}$$

wherein $$N'_q[m,k]=f(s_m[k])$$

is the loudness in quiet, and wherein $$N'_p[m,k]=f(g_m[k]s_m[k]e_m[k])$$

is the partial loudness of the processed signal in noise e[k].

Loudness models compute the partial specific loudness N'[m, k] of a signal s[k] when presented simultaneously with a masking signal e[k].

The gains $g_m[k]$ can be computed using a model of partial loudness, see, for example [10].

In the following, reference is made to computational models of partial loudness. Loudness models compute the partial specific loudness $N'(s_m[k]+e_m[k])$ of a signal s[k] when presented simultaneously with a masking signal e[k]:

$$N'[m,k]=f(s_m[k],e_m[k]) \tag{2}$$

A particular implementation of a perceptual model of partial loudness is shown in FIG. 6. It is derived from the models presented in [12] and [13] which itself drew on earlier research by Fletcher, Munson, Stevens, and Zwicker with some modifications. Alternative methods for the calculation of the specific loudness have been developed in the past, as, e.g. described in [14].

The input signals are processed in the frequency domain using a Short-time Fourier transform (STFT), for example, with a frame length of 21 ms, 50% overlap and a Hann window function. Mimicking the frequency resolution and the temporal resolution of the human auditory system, sub-band signals are obtained by grouping the spectral coefficients. The transfer through the outer and middle ear is simulated with a fixed filter. Additionally, the transfer function of the reproduction system can be incorporated optionally, but is neglected here for simplicity.

FIG. 7 illustrates the transfer function modeling the path through the outer and middle ear.

The excitation function is computed for auditory filter bands spaced on the equivalent rectangular bandwidth (ERB) scale or the Bark scale.

FIG. 8 illustrates a simplified spacing of auditory filter bands as an example for a perceptually motivated spacing of the frequency bands.

In addition to the temporal integration due to the windowing of the STFT, a recursive integration can be used, with different time constants during attack and decay. The specific partial loudness, e.g., the partial loudness evoked in each of the auditory filter bands, is computed from the excitation levels from the signal of interest (the stimulus) and the interfering noise according to Equations (17)-(20) in [12]. These equations cover the four cases where the signal is above the hearing threshold in noise or not, and where the excitation of the mixture signal is less than 100 dB SPL or not. If no interfering signal is fed into the model, e.g. e[k]=0, the result equals the total loudness N[k] of the stimulus s[k] and should predict the information represented in the equal loudness contours (ELC), as shown in FIG. 9. There, FIG. 9 illustrates equal loudness contours, ISO226-2003, from [15].

Examples of outputs of the model are shown in FIGS. 10 and 11.

FIG. 10 illustrates specific partial loudness, exemplarily for frequency band 4, wherein the function of noise excitation ranges from 0 to 100 dB.

FIG. 11 illustrates specific partial loudness in noise with 40 dB noise excitation.

U.S. Pat. No. 7,050,966 (see [16]) describes a method for enhancing the intelligibility of speech in noise and mentions the combination of ANC and PNC, however, no teaching is given of how ANC and PNC can be advantageously combined.

SUMMARY

According to an embodiment, an apparatus for improving a perceived quality of sound reproduction of an audio output signal may have: an active noise cancellation unit for generating a noise cancellation signal using an environmental audio signal as an input, wherein the environmental audio signal has noise signal portions, the noise signal portions resulting from recording environmental noise, a residual noise characteristics estimator for determining a remaining noise estimate depending on the environmental noise and the noise cancellation signal, a perceptual noise compensation unit for generating a noise-compensated signal based on an audio target signal and the remaining noise estimate, and a combiner for combining the noise cancellation signal and the noise-compensated signal to obtain the audio output signal, wherein the residual noise characteristics estimator is arranged to receive the environmental audio signal, wherein the residual noise characteristics estimator is arranged to receive the noise cancellation signal from the active noise cancellation unit, and wherein the residual noise characteristics estimator is configured to determine the remaining noise estimate using the environmental audio signal and using the noise cancellation signal.

According to another embodiment, an apparatus for improving a perceived quality of sound reproduction of an audio output signal may have: an active noise cancellation unit for generating a noise cancellation signal using an environmental audio signal as an input, wherein the environmental audio signal has noise signal portions, the noise signal portions resulting from recording environmental noise, a residual noise characteristics estimator for determining a remaining noise estimate depending on the environmental noise and the noise cancellation signal, a perceptual noise compensation unit for generating a noise-compensated signal based on an audio target signal and the remaining noise estimate, and a combiner for combining the noise cancellation signal and the noise-compensated signal to obtain the audio output signal, wherein the residual noise characteristics estimator is arranged to receive the environmental audio signal, wherein the residual noise characteristics estimator is arranged to receive the noise-compensated signal from the perceptual noise compensation unit, and wherein the residual noise characteristics estimator is configured to determine the remaining noise estimate based on the environmental audio signal and based on the noise-compensated signal, wherein the residual noise characteristics estimator is configured to determine the remaining noise estimate by subtracting scaled components of the noise-compensated signal from the environmental audio signal, and wherein the residual noise characteristics estimator is configured to determine the scaled components of the noise-compensated signal by scaling the received noise-compensated signal by a predetermined scale factor, wherein the predetermined scale factor indicates a signal level difference between an average signal level of an emitted signal when being emitted at a loudspeaker and an average signal level of the emitted signal when being recorded at a microphone.

According to still another embodiment, a headphone having two ear-cups may have: an apparatus for improving a perceived quality of sound reproduction as mentioned above, a loudspeaker, and at least one microphone for recording the environmental audio signal.

According to another embodiment, a method for improving a perceived quality of sound reproduction of an audio output signal may have the steps of: generating a noise cancellation signal using an environmental audio signal as an input, wherein the environmental audio signal has noise signal portions, the noise signal portions resulting from recording environmental noise, determining a remaining noise estimate depending on the environmental noise and the noise cancellation signal, generating a noise-compensated signal based on an audio target signal and the remaining noise estimate, and combining the noise cancellation signal and the noise-compensated signal to obtain the audio output signal, wherein determining the remaining noise estimate is conducted using the environmental audio signal and the noise cancellation signal.

According to another embodiment, a method for improving a perceived quality of sound reproduction of an audio output signal may have the steps of: generating a noise cancellation signal using an environmental audio signal as an input, wherein the environmental audio signal has noise signal portions, the noise signal portions resulting from recording environmental noise, determining a remaining noise estimate depending on the environmental noise and the noise cancellation signal, generating a noise-compensated signal based on an audio target signal and the remaining noise estimate, and combining the noise cancellation signal and the noise-compensated signal to obtain the audio output signal, wherein determining the remaining noise estimate is conducted based on the environmental audio signal and based on the noise-compensated signal, wherein determining the remaining noise estimate by subtracting scaled components of the noise-compensated signal from the environmental audio signal, and wherein determining the scaled components of the noise-compensated signal is conducted by scaling the received noise-compensated signal by a predetermined scale factor, wherein the predetermined scale factor indicates a signal level difference between an average signal level of an emitted signal when being emitted at the loudspeaker and an average signal level of the emitted signal when being recorded at the microphone.

Another embodiment may have a computer program for implementing the above methods for improving a perceived quality of sound reproduction of an audio output signal when being executed on a computer or signal processor.

An apparatus for improving a perceived quality of sound reproduction of an audio output signal is provided. The apparatus comprises an active noise cancellation unit for generating a noise cancellation signal based on an environmental audio signal, wherein the environmental audio signal comprises noise signal portions, the noise signal portions resulting from recording environmental noise. Moreover, the apparatus comprises a residual noise characteristics estimator for determining a residual noise characteristic depending on the environmental noise and the noise cancellation signal. Furthermore, the apparatus comprises a perceptual noise compensation unit for generating a noise-compensated signal based on an audio target signal (a desired signal) and based on the residual noise characteristic. Moreover, the apparatus comprises a combiner for combining the noise cancellation signal and the noise-compensated signal to obtain the audio output signal.

According to the present invention, concepts are provided for reproducing the audio signals such that their timbre, loudness and intelligibility when presented in an environmental noise are similar or close to those when presented unprocessed in quiet. The proposed concepts incorporate a combination of Active Noise Cancellation and Perceptual Noise Compensation. Active Noise Cancellation is applied to remove the interfering noise signals as much as possible. Perceptual Noise Compensation is applied to compensate for the remaining noise components. The combination of both can be efficiently implemented by using the same transducers.

Embodiments of the present invention are based on the concept to process the desired audio signal s[k] by taking psychoacoustic findings into account. By this, the adverse perceptual effect of the residual noise components e[k] are subsequently compensated for by processing the desired audio signals s[k] by taking psychoacoustic findings of the Perceptual Noise Compensation into account.

Embodiments are based on the finding that ANC can physically cancel the interfering noise only partially. It is imperfect and consequently some residual noise remains at the ear entrances of the listener as shown in the schematic diagram of an exemplary implementation of a sound reproduction system according to the state of the art in FIG. 12.

According to an embodiment, the residual noise characteristics estimator may be configured to determine the residual noise characteristic such that the residual noise characteristic indicates a characteristic of noise portions of the environmental noise that would remain when only reproducing the noise cancellation signal.

In a further embodiment, the residual noise characteristics estimator may be arranged to receive the environmental audio signal. The residual noise characteristics estimator may be arranged to receive information on the noise cancellation signal from the active noise cancellation unit, and wherein the residual noise characteristics estimator is configured to determine the residual noise characteristic based on the environmental audio signal and based on the information on the noise cancellation signal. The remaining noise estimate may, e.g., indicate the noise portions of the environmental noise that would remain when only reproducing the noise cancellation signal.

According to another embodiment, the residual noise characteristics estimator may be arranged to receive the noise cancellation signal as the information on the noise cancellation signal from the active noise cancellation unit. The residual noise characteristics estimator may be configured to determine the remaining noise estimate based on the environmental audio signal and based on the noise cancellation signal.

According to a further embodiment, the residual noise characteristics estimator may be configured to determine the remaining noise estimate by adding the environmental audio signal and the noise cancellation signal.

In another embodiment, the apparatus furthermore comprises at least one loudspeaker and at least one microphone. The microphone may be configured to record the environmental audio signal, the loudspeaker may be configured to output the audio output signal, and wherein the microphone and the loudspeaker may be arranged to implement a feed-forward structure.

According to another embodiment, the residual noise characteristics estimator may be arranged to receive the environmental audio signal, wherein the residual noise characteristics estimator may be arranged to receive information on the noise-compensated signal from the perceptual noise compensation unit. The residual noise characteristics estimator may be configured to determine as the residual noise characteristic a remaining noise estimate based on the environmental audio signal and based on the noise-compensated signal. The remaining noise estimate may, e.g., indicate the noise portions of the environmental noise that would remain when only reproducing the noise cancellation signal.

In another embodiment, the residual noise characteristics estimator may be arranged to receive the noise-compensated signal as the information on the noise-compensated signal from perceptual noise compensation unit. The residual noise characteristics estimator may be configured to determine the remaining noise estimate based on the environmental audio signal and based on the noise-compensated signal.

According to a further embodiment, the residual noise characteristics estimator may be configured to determine the remaining noise estimate by subtracting scaled components of the noise-compensated signal from the environmental audio signal.

In another embodiment, the apparatus may furthermore comprise at least one loudspeaker and at least one microphone. The microphone may be configured to record the environmental audio signal, the loudspeaker may be configured to output the audio output signal, and the microphone and the loudspeaker may be arranged to implement a feedback structure.

According to another embodiment, the apparatus may furthermore comprise a source separation unit for detecting signal portions of the environmental audio signal which shall not be compensated for, e.g., speech or alarm sounds.

In a further embodiment, the source separation unit may be configured to remove the signal portions of the environmental audio signal which shall not be compensated from environmental audio signal.

According to an embodiment, a headphone is provided. The headphone comprises two ear-cups, an apparatus for improving a perceived quality of sound reproduction according to one of the above-described embodiments, and at least one microphone for recording the environmental audio signal. In this context, concepts for the reproduction of audio signals over headphones in noisy environments are provided.

In an embodiment, a method for improving a perceived quality of sound reproduction of an audio output signal is provided. The method comprises:

Generating a noise cancellation signal based on an environmental audio signal, wherein the environmental audio signal comprises noise signal portions, the noise signal portions resulting from recording environmental noise.

Determining a residual noise characteristic depending on the environmental noise and the noise cancellation signal.

Generating a noise-compensated signal based on an audio target signal and based on the residual noise characteristic, and:

Combining the noise cancellation signal and the noise-compensated signal to obtain the audio output signal.

BRIEF DESCRIPTION OF THE DRAWINGS

In the following, embodiments of the present invention are described in more detail with reference to the figures, in which.

DETAILED DESCRIPTION OF THE INVENTION

Figure 1:
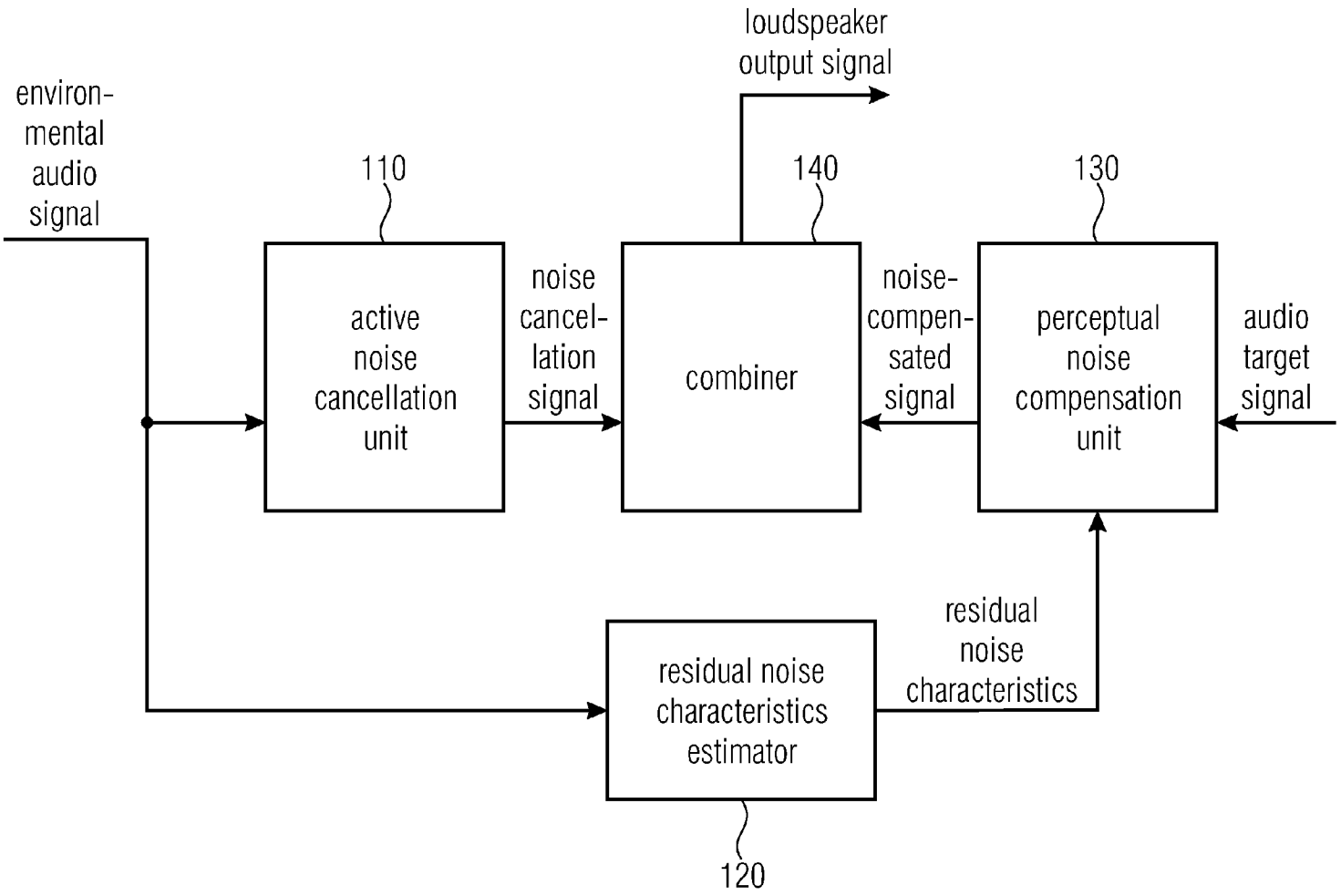
FIG. 1 is an apparatus for improving a perceived quality of sound reproduction according to an embodiment.

FIG. 1 illustrates an apparatus for improving a perceived quality of sound reproduction of an audio output signal according to an embodiment. The apparatus comprises an active noise cancellation unit 110 for generating a noise cancellation signal based on an environmental audio signal. The environmental audio signal comprises noise signal portions, wherein the noise signal portions result from recording environmental noise. Moreover, the apparatus comprises a residual noise characteristics estimator 120 for determining a residual noise characteristic depending on the environmental noise and the noise cancellation signal. Furthermore, the apparatus comprises a perceptual noise compensation unit 130 for generating a noise-compensated signal based on an audio target signal and based on the residual noise characteristic. Moreover, the apparatus comprises a combiner 140 for combining the noise cancellation signal and the noise-compensated signal to obtain the audio output signal. In this context, environmental noise may be any kind of noise which occurs in an environment, e.g. an environment of a recording microphone, an environment of a loudspeaker or an environment where a listener perceives emitted sound waves.

Embodiments of the apparatus for improving a perceived quality of sound reproduction of an audio output signal are based on the finding that ANC can physically cancel the interfering noise only partially. ANC is imperfect and consequently some residual noise remains at the ear entrances of the listener as shown in the schematic diagram of the exemplary implementation according to the state of the art illustrated in FIG. 12.

To overcome this disadvantage, according to some embodiments, the residual noise characteristics estimator 120 may be configured to determine the residual noise characteristic such that the residual noise characteristic indicates a characteristic of noise portions of the environmental noise that would remain when only reproducing the noise cancellation signal, e.g., when the noise cancellation signal would be reproduced, e.g., by a loudspeaker.

Figure 2:
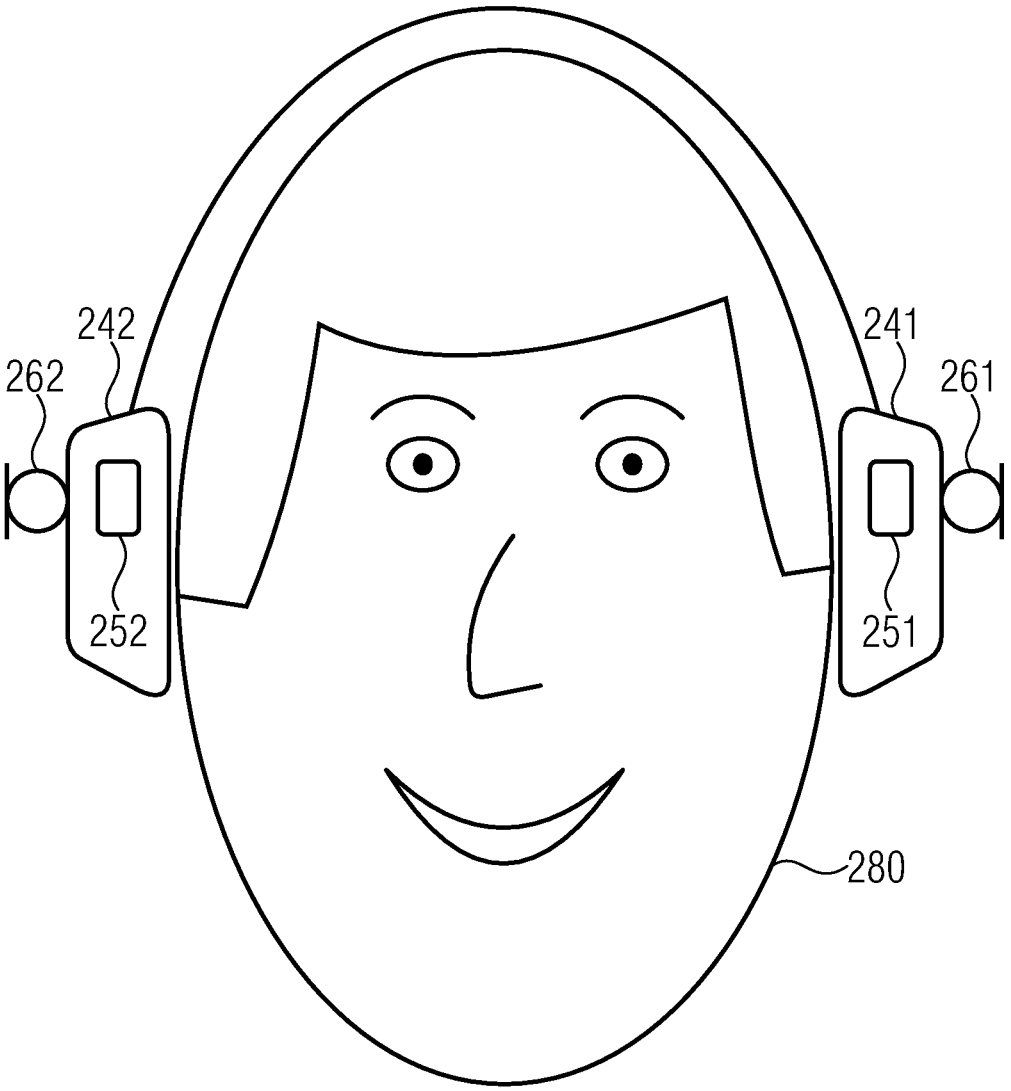
FIG. 2 illustrates a headphone according to an embodiment.
Figure 3:
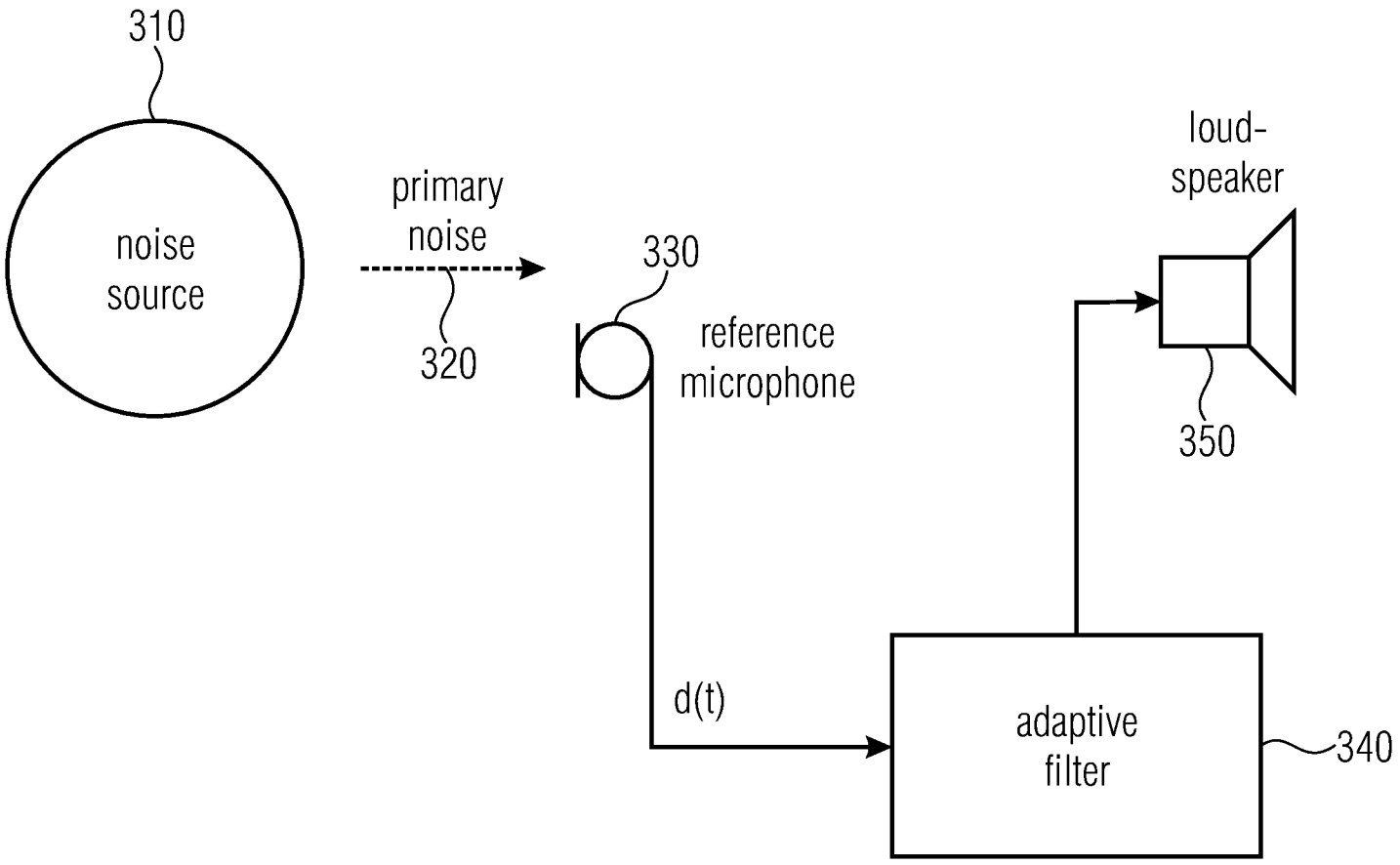
FIG. 3 is a block diagram of an active noise cancellation implementation with a feedforward structure.

An apparatus according to the above-described embodiment may be employed in a headphone. FIG. 2 illustrates a corresponding headphone according to such an embodiment.

The headphone comprises two ear-cups 241, 242. The ear-cup 241 may, for example, comprise at least one microphone 261 and an apparatus 251 for improving a perceived quality of sound reproduction according to one of the above-described embodiments. In the embodiment of the headphone of FIG. 2, the apparatus 251 for improving a perceived quality of sound reproduction may be integrated into the ear-cup 241. A loudspeaker of the ear-cup 241 may reproduce the audio output signal of the apparatus 251 for improving a perceived quality of sound reproduction. Likewise, the ear-cup 242 may, for example, comprise at least one microphone 262 and an apparatus 252 for improving a perceived quality of sound reproduction according to one of the above-described embodiments. In the embodiment of the headphone of FIG. 2, the apparatus 252 for improving a perceived quality of sound reproduction may be integrated into the ear-cup 242. A loudspeaker of the ear-cup 242 may reproduce the audio output signal of the apparatus 252 for improving a perceived quality of sound reproduction. Moreover, FIG. 2 illustrates a listener 280 wearing the headphone.

The headphone implements ANC. In embodiments, one or more microphones are mounted to the headphone of FIG. 2 for measuring the environmental noise and/or the residual noise at the ear entrances. The microphone signals are used to generate the secondary signal for canceling the noise. Additionally, PNC processing is conducted, which improves the perceived sound quality by compensating for the remaining noise signal by applying time-variant and signal-dependent spectral weights (filters) to the desired input signals. The estimate of the residual noise characteristics needed for the PNC processing for computing the filters is obtained from the microphone signals.

Different structures of implementations of ANC exists. A distinguishing feature between such structures is the position of the noise sensor in the processed chain, leading to two basic control structures, namely feedforward and feedback structure. The technical background on implementations of ANC has already been described above.

Figure 12:
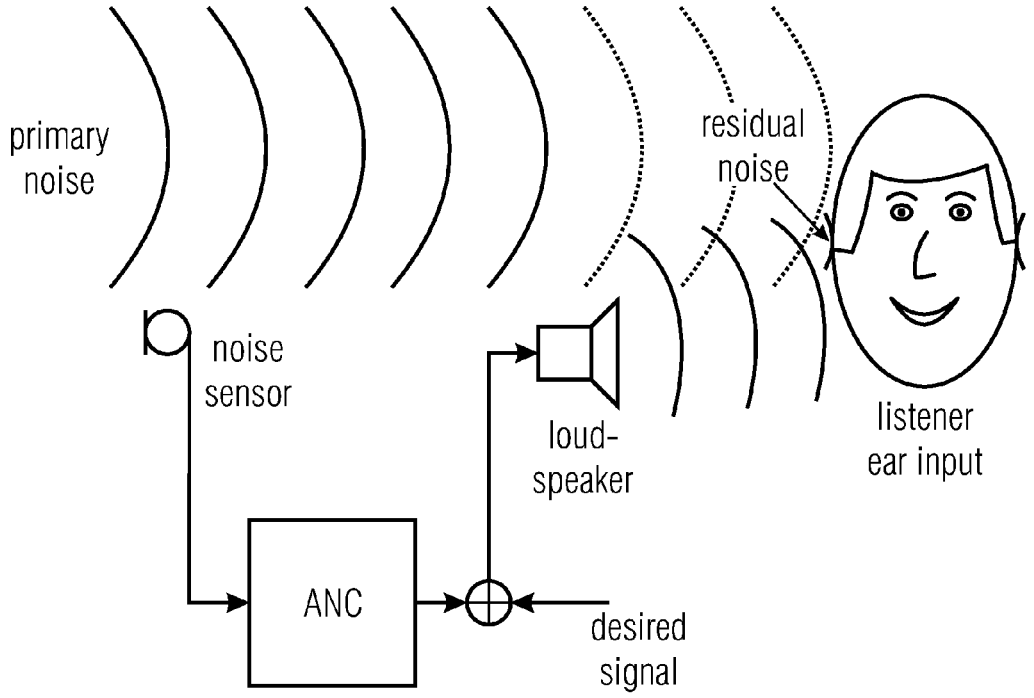
FIG. 12 is a block diagram of an exemplary implementation of a sound reproduction system with acoustic noise cancellation according to the state of the art with feedforward structure.
Figure 13:
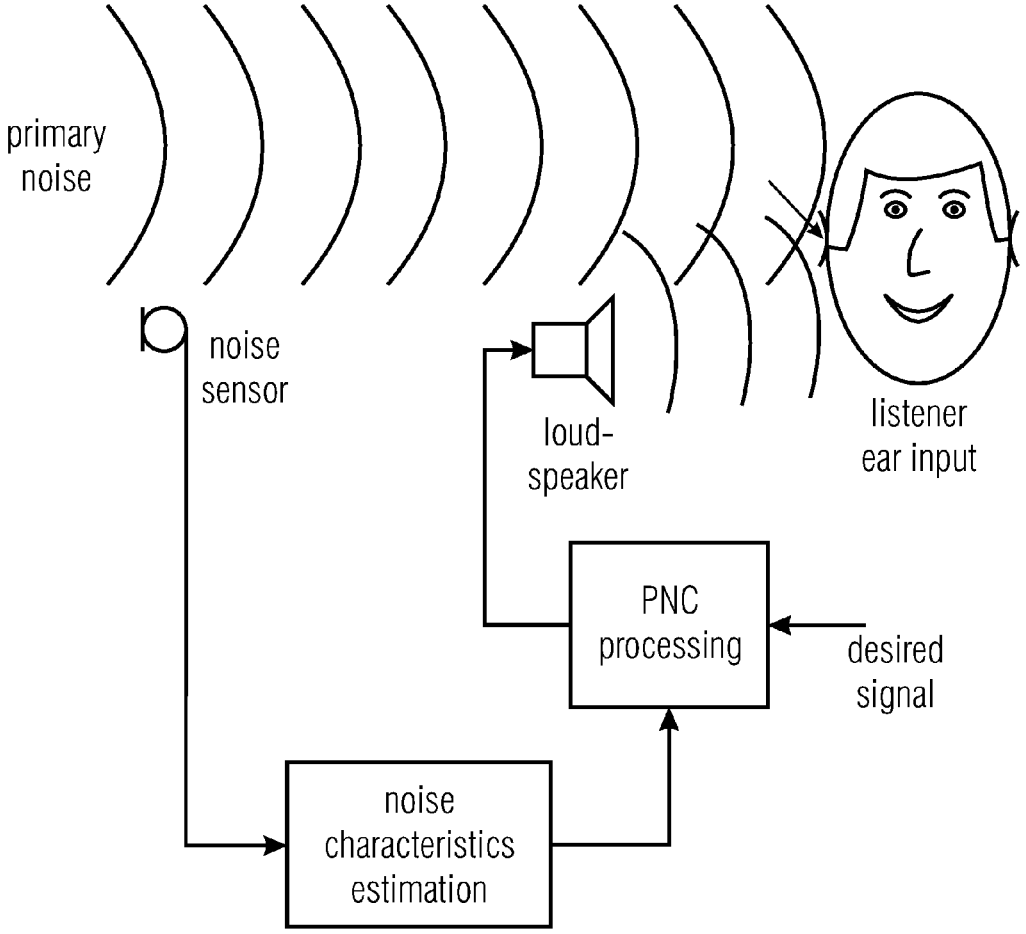
FIG. 13 is a block diagram of a sound reproduction system with Perceptual Noise Compensation according to the state of the art.

In the state of the art, which is illustrated by FIG. 12, the interfering noise is not canceled completely. The residual noise can be compensated in its adverse effects on the quality of the reproduced audio signal by using PNC, a signal processing method based on psychoacoustics. PNC applies time-varying equalization such that spectral components of the input signal are amplified which are masked by the interfering noise. This is typically achieved by using a spectral weighting method where the sub-band gains are computed by taking psychoacoustic knowledge and the characteristics of the desired signal (the audio target signal) and the interfering noise into account. More technical background on PNC implementations has already been provided above. A sound reproduction with PNC according to the state of the art is depicted in FIG. 13.

Figure 14:
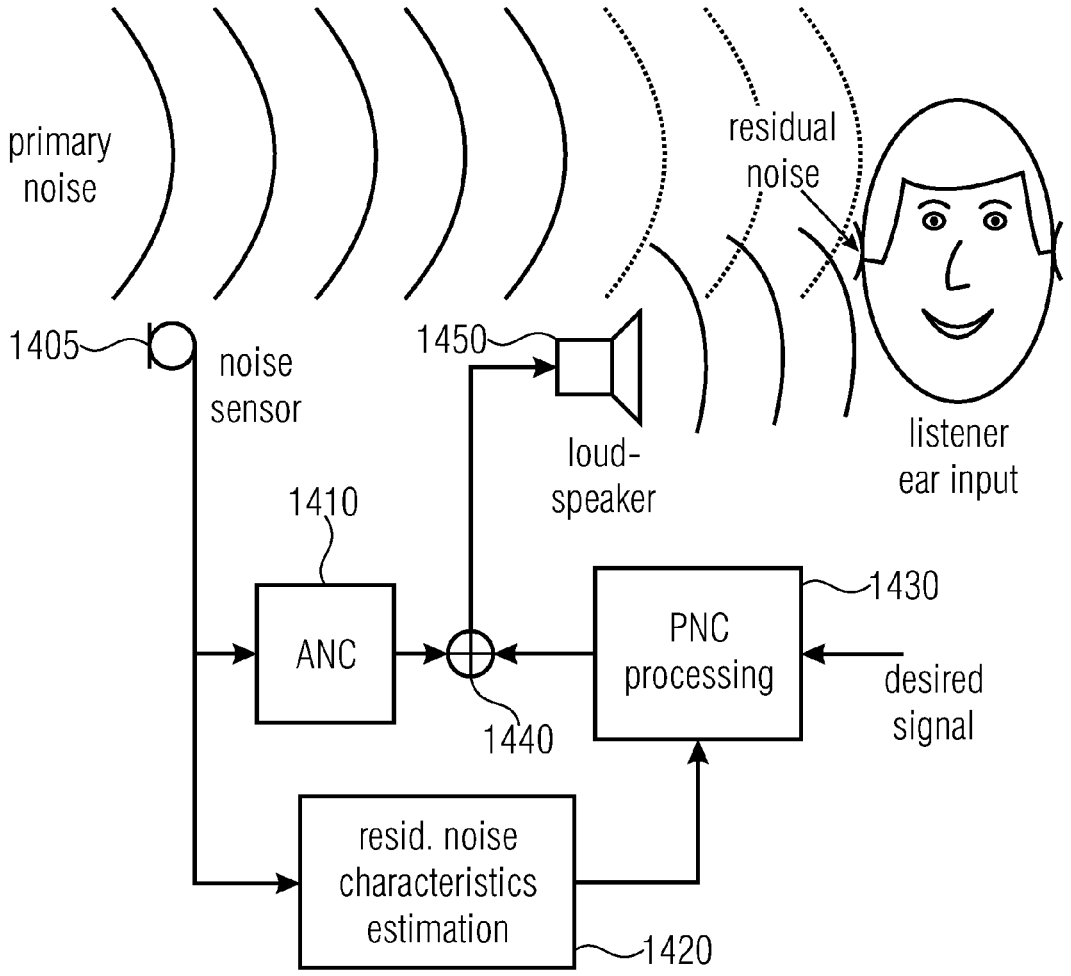
FIG. 14 is a block diagram of an exemplary implementation of a sound reproduction system with ANC and PNC according to an embodiment, where the primary noise sensor is used for estimating the characteristics of the residual noise.
Figure 15:
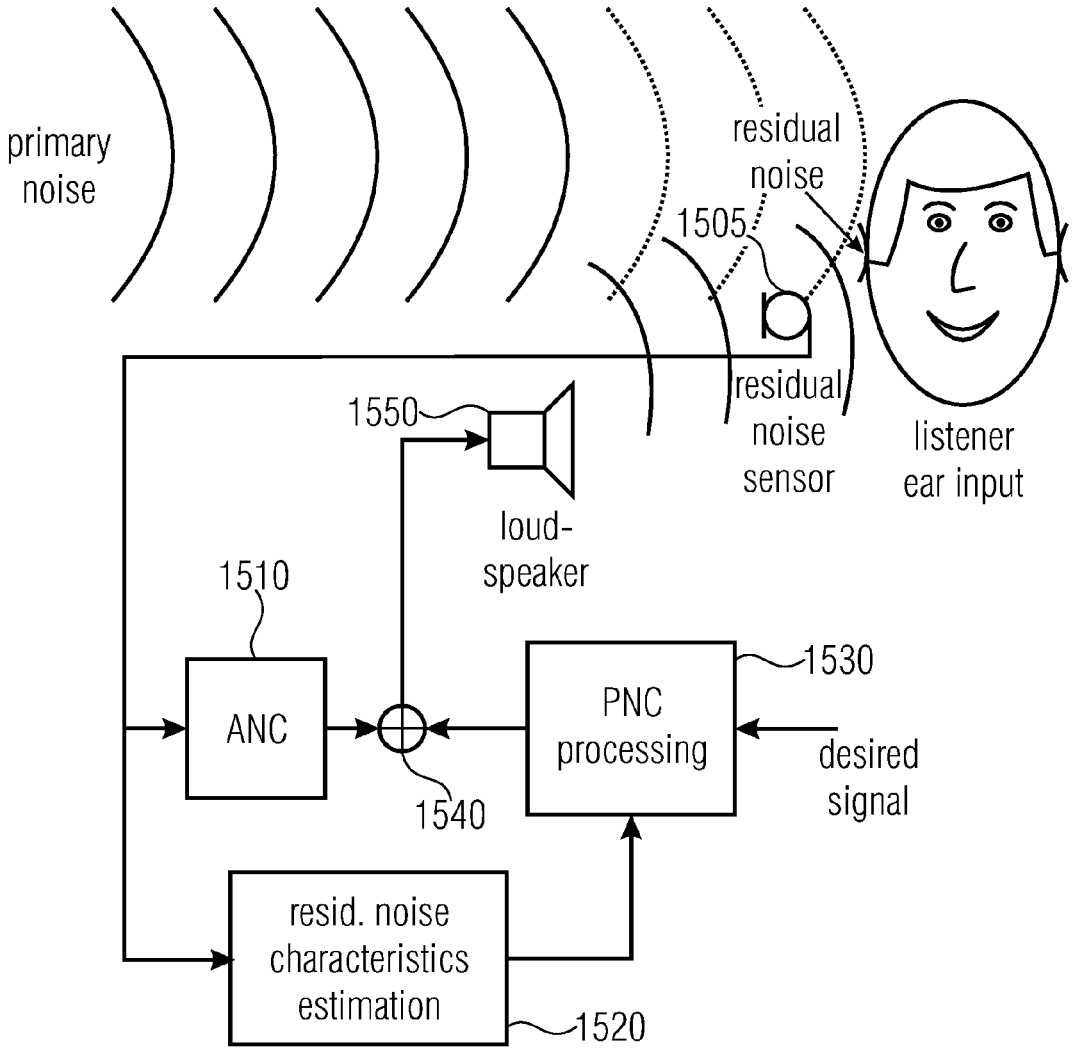
FIG. 15 is a block diagram of an alternative implementation of a sound reproduction system with ANC and PNC according to a further embodiment, where the residual noise sensor is used for estimating the characteristics of the residual noise.

FIGS. 14 and 15 illustrate sound reproduction systems according to embodiments. Both implementations include a means for estimating the characteristics of the residual noise, referred to as Residual Noise Characteristics Estimator (RNCE). A difference between the two implementations is the control structure used for the ANC (feedforward structure and feedback structure).

FIG. 14 illustrates an apparatus according to an embodiment, and, in particular, a combination of PNC with ANC in a feedforward structure. The RNCE is based on the primary noise sensor without a dedicated microphone for measuring the residual noise. The apparatus of the embodiment of FIG. 14 comprises an active noise cancellation unit 1410, a residual noise characteristics estimator 1420, a perceptual noise compensation unit 1430 and a combiner 1440, which may correspond to the active noise cancellation unit 110, the residual noise characteristics estimator 120, the perceptual noise compensation unit 130 and the combiner 140 of the embodiment of FIG. 1, respectively.

The apparatus of the embodiment of FIG. 14 furthermore comprises a loudspeaker 1450 and a microphone 1405. The microphone 1405 is configured to record the environmental audio signal. Moreover, the loudspeaker 1450 is configured to output the audio output signal. In the embodiment of FIG. 14, the microphone and the loudspeaker are arranged to implement a feedforward structure. A feedforward structure may, e.g., represent an arrangement of a microphone and a loudspeaker, wherein the microphone does not receive sound waves emitted by the loudspeaker.

FIG. 15 illustrates an implementation in feedback structure that takes advantage of a dedicated microphone for measuring the residual noise. In particular, FIG. 15 illustrates an apparatus for improving the perceived quality of sound reproduction, wherein the apparatus again comprises an active noise cancellation unit 1510, a residual noise characteristics estimator 1520, a perceptual noise compensation unit 1530 and a combiner 1540, which may correspond to the active noise cancellation unit 110, the residual noise characteristics estimator 120, the perceptual noise compensation unit 130 and the combiner 140 of the embodiment of FIG. 1, respectively.

As in the embodiment of FIG. 14, the apparatus of the embodiment of FIG. 15 furthermore comprises a loudspeaker 1550 and a microphone 1505. The microphone 1505 is configured to record the environmental audio signal. Moreover, the loudspeaker 1550 is configured to output the audio output signal. In contrast to FIG. 14, in FIG. 15, the microphone and the loudspeaker are arranged to implement a feedback structure. A feedback structure may, e.g., represent an arrangement of a microphone and a loudspeaker, wherein the microphone does receive sound waves emitted by the loudspeaker.

Figure 16:
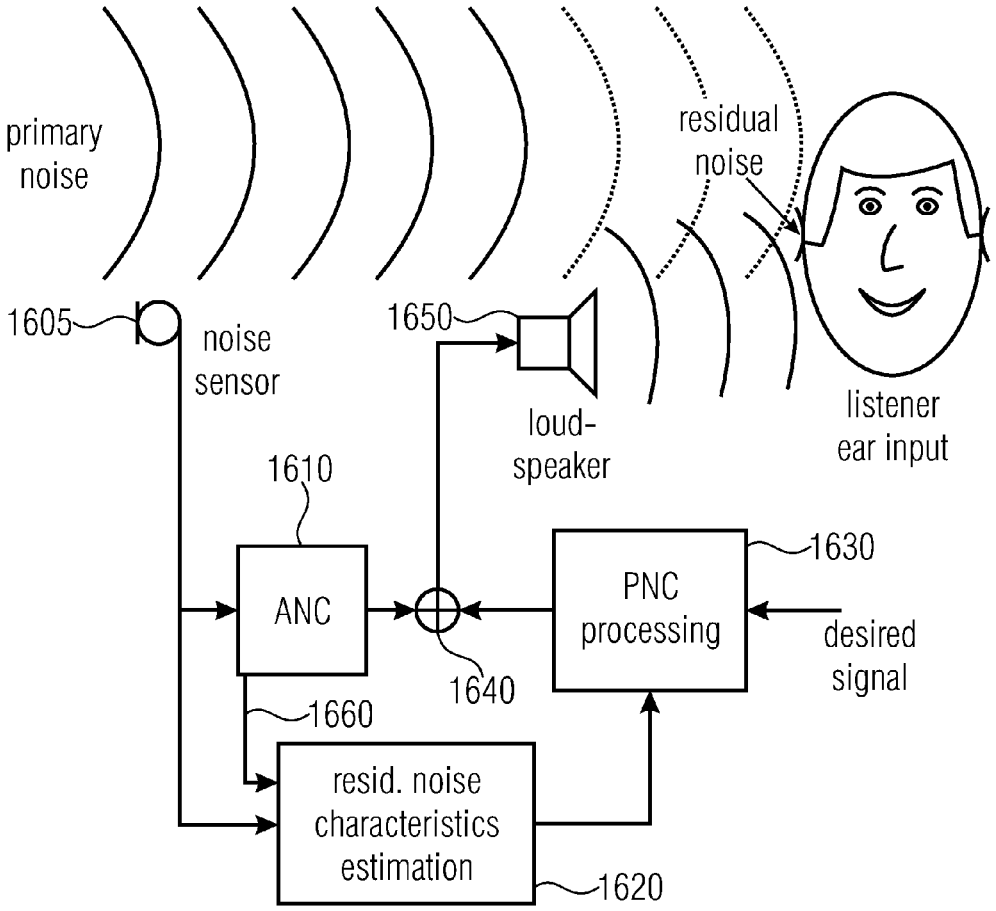
FIG. 16 is a block diagram of an exemplary implementation of a sound reproduction system with ANC and PNC according to another embodiment, where the primary noise sensor is used for estimating the characteristics of the residual noise.

FIG. 16 illustrates an apparatus according to an embodiment depicting more details than FIG. 14. The apparatus of the embodiment of FIG. 16 comprises an active noise cancellation unit 1610, a residual noise characteristics estimator 1620, a perceptual noise compensation unit 1630 and a combiner 1640, a microphone 1605 and a loudspeaker 1650. The microphone 1605 and the loudspeaker 1650 implement a feedforward structure.

In the embodiment of FIG. 16, the residual noise characteristics estimator 1620 is arranged to receive information on the noise cancellation signal from the active noise cancellation unit 1610. This is indicated by arrow 1660. The residual noise characteristics estimator 1620 is configured to determine as the residual noise characteristic a remaining noise estimate which may, e.g., indicate the noise portions of the environmental noise that would remain when only the noise cancellation signal (and not, e.g. also a signal resulting from PNC) would be reproduced.

As FIG. 16 implements a feedforward structure, the environmental audio signal may, e.g., only comprise noise signal components. The residual noise characteristics estimator 1620 may receive the noise cancellation signal from the active noise cancellation unit 1610 and may, for example, add this noise cancellation signal (anti-noise) to the environmental audio signal. The resulting signal may then be the noise estimate representing the environmental noise that would remain when only reproducing the noise cancellation signal.

Figure 17:
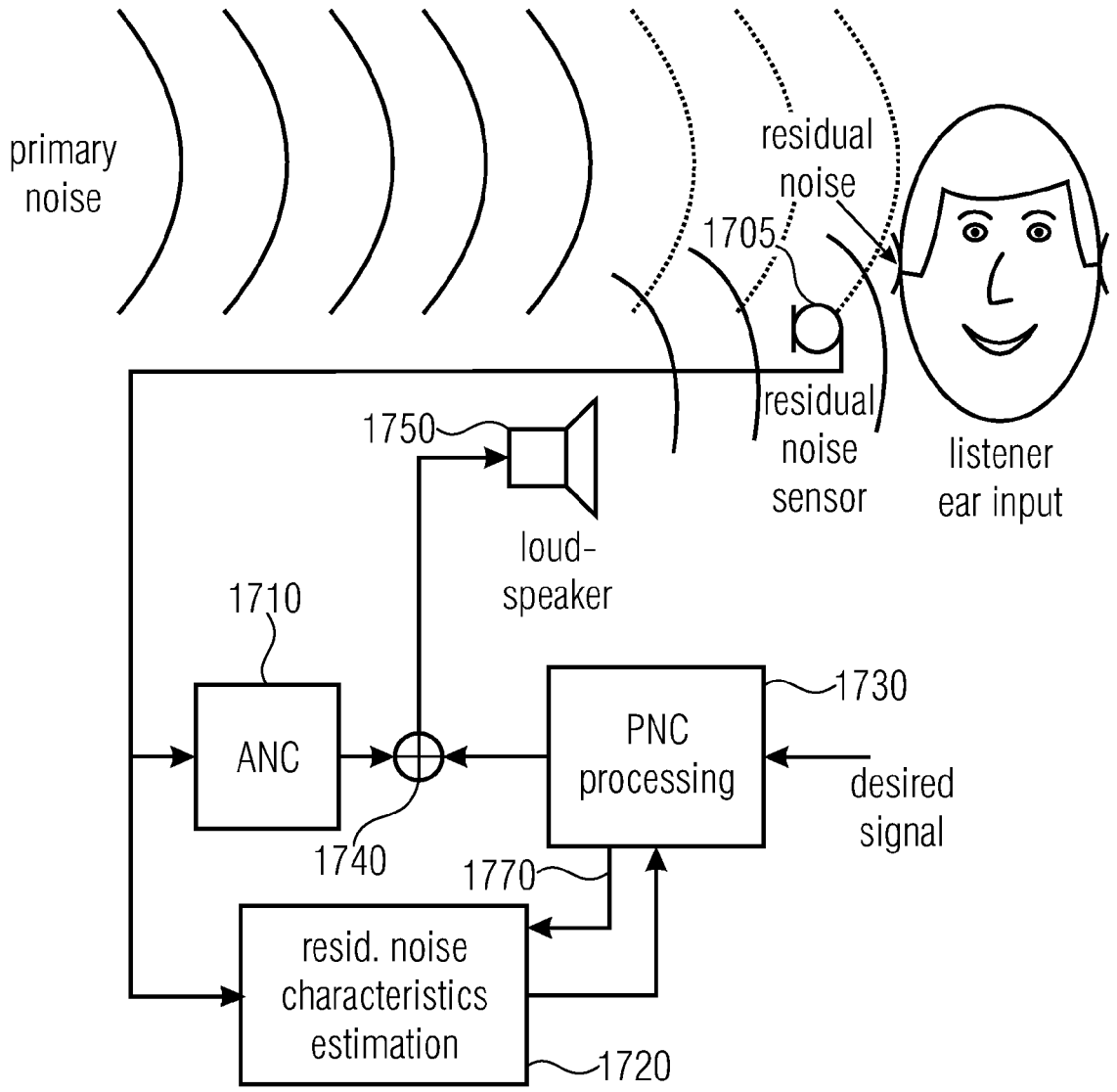
FIG. 17 is a block diagram of an alternative implementation of a sound reproduction system with ANC and PNC according to a further embodiment, where the residual noise sensor is used for estimating the characteristics of the residual noise.

FIG. 17 illustrates an apparatus according to an embodiment depicting more details than FIG. 15. The apparatus of the embodiment of FIG. 17 comprises an active noise cancellation unit 1710, a residual noise characteristics estimator 1720, a perceptual noise compensation unit 1730, a combiner 1740, a microphone 1705 and a loudspeaker 1750. The microphone 1705 and the loudspeaker 1750 implement a feedback structure.

In the embodiment of FIG. 17, the residual noise characteristics estimator 1720 is arranged to receive information on the noise-compensated signal from the perceptual noise compensation unit 1730. This is indicated by arrow 1770. The residual noise characteristics estimator 1720 may be configured to determine as the residual noise characteristic a remaining noise estimate which may, e.g., indicate the noise portions of the environmental noise that would remain when only the noise cancellation signal (and not also a signal resulting from PNC) would be reproduced.

As FIG. 17 implements a feedback structure, the environmental audio signal which represents the recorded sound waves in the environment of the microphone also comprises the noise-compensated signal. The residual noise characteristics estimator 1720 may receive the noise-compensated signal from the perceptual noise compensation unit 1730, and may subtract scaled components of the received noise-compensated signal from the environmental audio signal. For example, the scaled components of the received noise-compensated signal may be determined by scaling the received noise-compensated signal by a predetermined scale factor. The resulting signal may then be the noise estimate representing the environmental noise that would remain when only reproducing the noise cancellation signal. The predetermined scale factor may, for example, be a signal level difference between an average signal level of a signal when being emitted at the loudspeaker and an average signal level of the signal when being recorded at the microphone.

Some of the advantages of combining ANC and PNC are:

Improved sound quality: additionally compensating for the residual noise is an improvement over ANC, and, vice versa cancellation of the low-frequency noise components prior to PNC guarantees your listening experiences at low payback levels.

Cost-efficient implementation: ANC and PNC can use the same transducers (both, microphones and loudspeakers). The RNCE can be obtained from a noise sensor, e.g. a residual noise sensor or from the primary noise sensor by taking the ANC suppression characteristics into account.

Two different ways for obtaining the noise estimate may be used. These two ways depend on the structure of the ANC implementation:

If the implementation of the ANC features a microphone for measuring the residual noise, the noise estimate is obtained from this sensor and the crosstalk of the desired signal into the sensor needs to be suppressed.

If the ANC is implemented in a feedforward structure with only one microphone for sensing the primary noise, the noise estimate can be obtained from this sensor using a model of the transfer through the headphone (including mechanical dumping of the external noise due to passive absorption by the headphone and the ANC.

In general, the noise estimation may comprise:

1. The cancellation of the crosstalk of the music playback into the microphone.

2. The modelling of the transfer function/attenuation of the outer noise through the ear-cup and the ANC processing.

3. Optionally, a signal analysis, possibly combined with a source separation processing, in order to avoid compensation/marking of certain outside sounds which are desired to be perceived by the headphone listener, e.g. speech and alarm sounds.

To achieve crosstalk suppression, the PNC scales the desired signal with sub-band gain values which are monotonically increasing with increasing noise sub-band level. If the music playback is picked-up by the microphone and adds to the noise estimate, the resulting feedback can potentially lead to over-compensation and excessive amplification of the corresponding sub-band signals. Therefore, the crosstalk of the music playback into the microphones needs to be suppressed.

Before the environmental noise reaches the ear entrances, it is damped by the passive attenuation of the ear-cups and by the ANC processing. The transfer through the headphone is modelled by the function $f_{HP}$, see equation (3):

$$e[k]=f_{HP}(d[k]) \tag{3}$$

wherein d[k] denotes an external noise and wherein e[k] denotes a noise estimate.

The transfer can be modelled as a Linear Time-Invariant (LTI) system or as a non-linear system. Such system identification methods use a series of measurements of the input and output signals and determine the model parameters such that an error measure between output measurements and predicted output is minimized.

In the first case (modelling as an LTI system), the system is described by its impulse response or magnitude transfer function.

Figure 21:
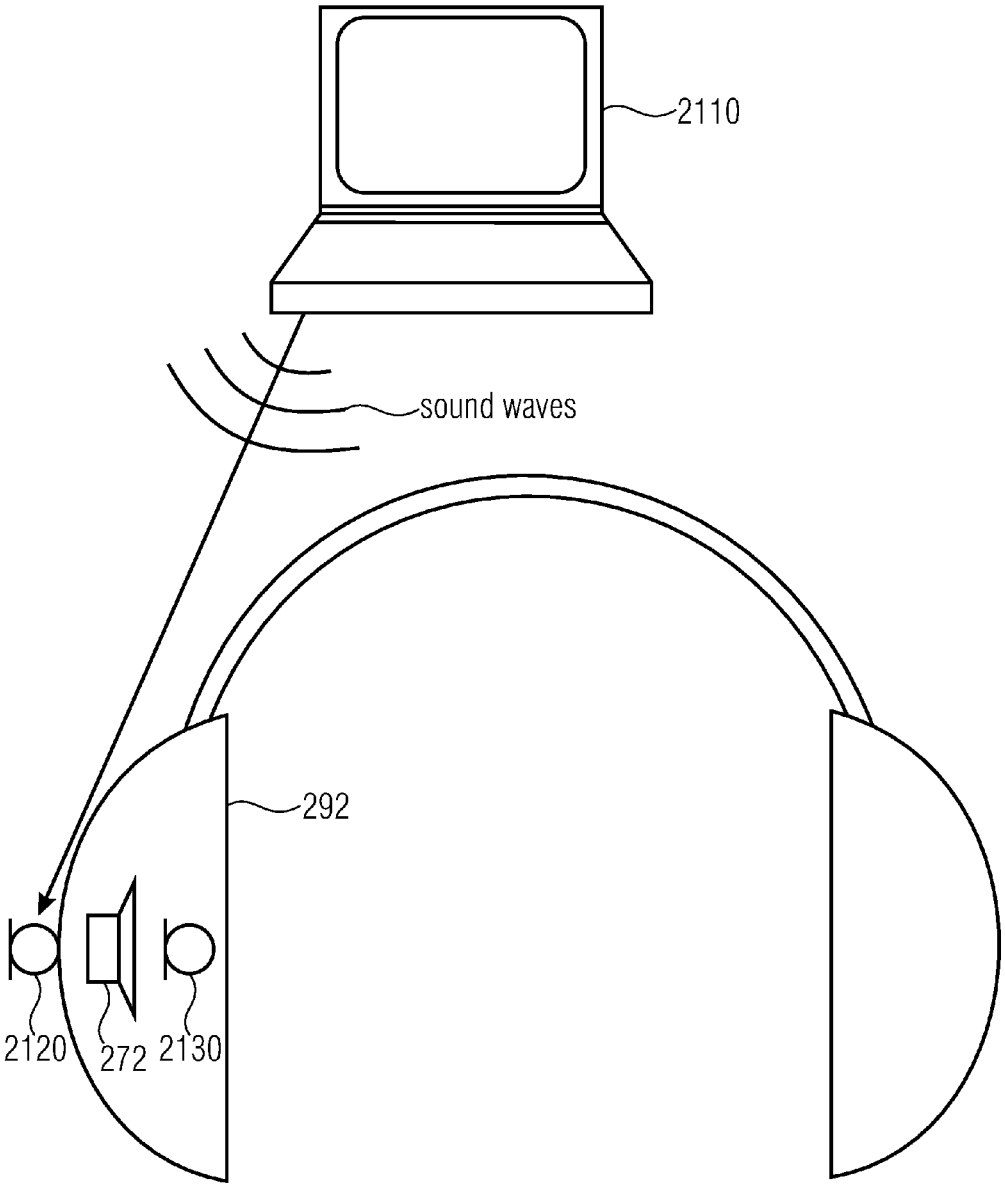
FIG. 21 illustrates a test arrangement for modelling the transfer through the headphones and ANC processing as a Linear Time Invariant system according to an embodiment.

FIG. 21 illustrates a test arrangement for modelling the transfer through the headphones and ANC processing as a Linear Time-Invariant system according to an embodiment. In FIG. 21, a test signal is fed into a first loudspeaker 2110. The test signal should have a broad frequency spectrum. In response, the first loudspeaker 2110 outputs sound waves which are then recorded by a first microphone 2120 arranged on an ear-cup 242 of a headphone as a first recorded audio signal. The first recorded audio signal records sound waves that have not yet passed through the ear-cup 242. Moreover, ANC processing has not yet been conducted.

The test signal can be considered as an excitation signal of a first LTI system. Moreover, the first recorded audio signal can be considered as an output signal of the first LTI system. In an embodiment, an impulse response of the first LTI system is calculated based on the test signal and based on the first recorded audio signal as a first impulse response. For this purpose, the test signal should have a broad frequency spectrum. Furthermore, the first impulse response is transferred to the frequency domain, e.g. by conducting STFT (Short-Time Fourier Transform), to obtain a first frequency response. In an alternative embodiment, the first frequency response is directly determined based on frequency-domain representations of the test signal and the first recorded audio signal.

Moreover, to obtain a second recorded microphone signal, a second microphone 2130 records sound waves that have passed through the ear-cup 242 and after ANC has been conducted. To conduct ANC, an ear-cup loudspeaker 272 of the ear-cup 242 is employed to output so-called "anti-noise" for cancelling the sound waves from the first loudspeaker.

Again, the test signal can be considered as an excitation signal of a further, second LTI system. The second recorded microphone signal can be considered as an output signal of the second LTI system. According to an embodiment, an impulse response of the second LTI system is calculated based on the test signal and based on the second recorded audio signal as a second impulse response. Furthermore, the second impulse response is transferred to the frequency domain to obtain a second frequency response. In an alternative embodiment, the second frequency response is directly determined based on frequency-domain representations of the test signal and the first recorded audio signal.

This is explained in more detail with reference to FIG. 22. The second LTI system 2220 can be considered to comprise two LTI systems, namely the first LTI system 2210, already described with respect to FIG. 21 and a third LTI system 2230. The first LTI system 2210 receives the test signal (output by the first loudspeaker 2110) as an excitation signal. Moreover, the first LTI system 2210 outputs the first recorded audio signal (recorded by the first microphone 2120). The third LTI system 2230 receives the first recorded audio signal as an excitation signal and outputs the second recorded audio signal (recorded by the second microphone).

To model ANC and the influence of the transfer of the sound waves through the ear-cups, the third LTI system 2230 is determined. In an embodiment, the frequency response of the third LTI system 2230 is calculated as a third frequency response based on the first frequency response of the first LTI system 2210 and based on the second frequency response of the second LTI system 2220.

In an embodiment, the second frequency response of the second LTI system 2220 is divided by the first frequency response of the first LTI system 2210 to obtain the third frequency response of the third LTI system 2230.

Figure 23:
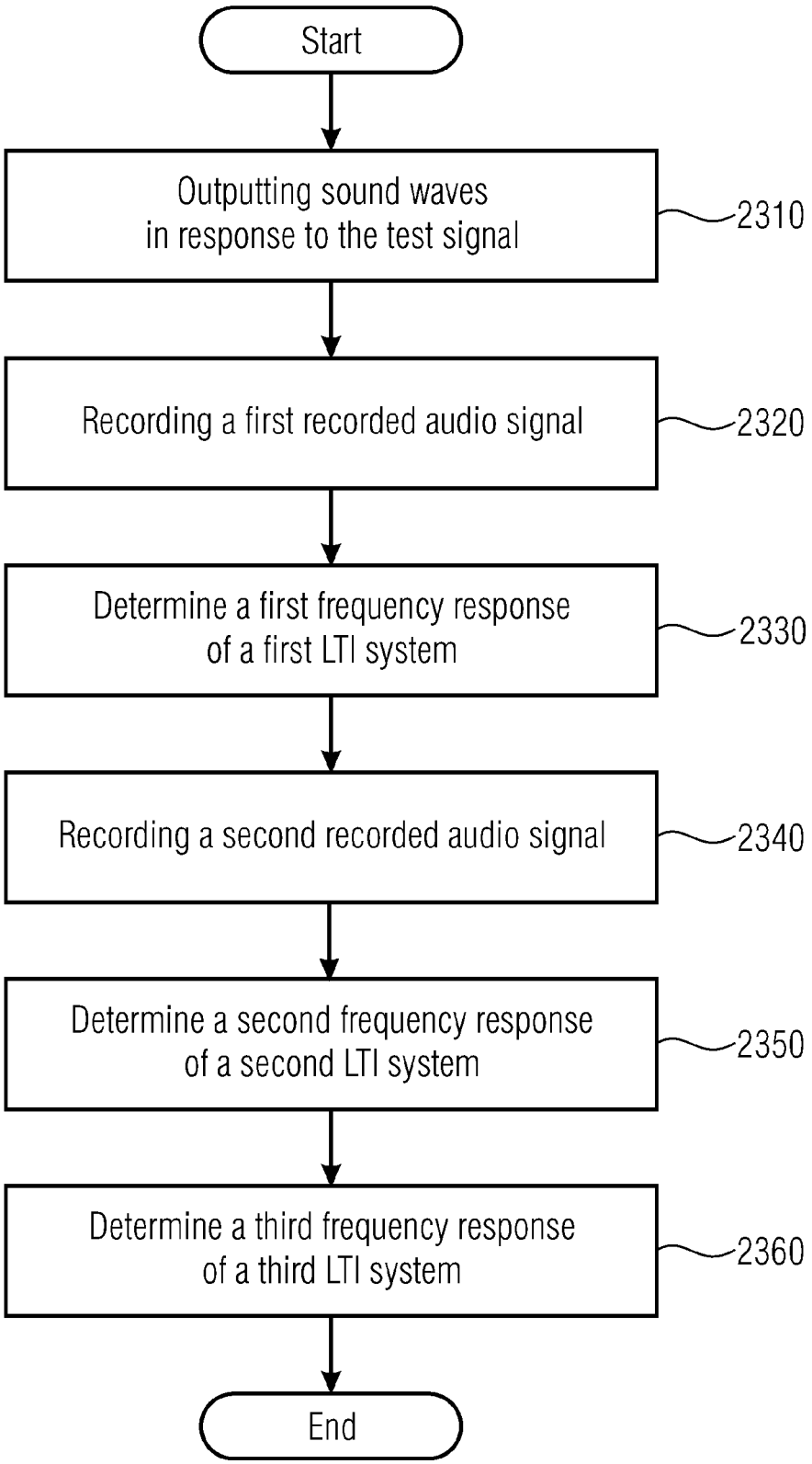
FIG. 23 illustrates a flow chart depicting the steps conducted to model the transfer through the headphones and ANC processing as a Linear Time-Invariant system according to an embodiment.

FIG. 23 illustrates a flow chart depicting the steps to model the transfer through the headphones and ANC processing as a Linear Time-Invariant system according to an embodiment.

In step 2310, a test signal is fed into a first loudspeaker. The first loudspeaker outputs sound waves in response to the test signal.

In step 2320, a first microphone arranged on an ear-cup of a headphone records the sound waves to obtain a first recorded audio signal.

In step 2330, a first frequency response of a first LTI system is determined based on the test signal as an excitation signal of the first LTI system and based on the first recorded audio signal as an output signal of the first LTI system.

In step 2340, a second microphone records a second recorded audio signal after the sound waves have been passed through the ear-cup and after ANC has been conducted.

In step 2350, a second frequency response of a second LTI system is determined based on the test signal as an excitation signal of the second LTI system and based on the second recorded audio signal as an output signal of the second LTI system.

In step 2360, a third frequency response of a third LTI system is determined based on the first frequency response of the first LTI system and based on the second frequency response of the second LTI system.

In an alternative embodiment, the first impulse response and the first frequency response of the LTI system and the second impulse response and the second frequency response of the LTI system are not determined. Instead, the frequency response of the third LTI system is determined based on the first recorded audio signal as an excitation signal of the third LTI system and based on the second recorded audio signal as an output signal of the third LTI system.

In embodiments, the third frequency response may be transformed from the frequency domain to the time domain to obtain the impulse response of the third LTI systems.

In some embodiments, the frequency response and/or the impulse response of the third LTI system, which reflects the effect of the ANC and of the transfer of the sound waves through the ear-cup, is available for a residual noise characteristics estimator. In some embodiments, a residual noise characteristics estimator may determine the frequency response and/or the impulse response of the third LTI system.

The residual noise characteristics estimator may use the frequency response and/or the impulse response of the third LTI system to determine a residual noise characteristic of the environmental audio signal. For example, the residual noise characteristics estimator may multiply a frequency-domain representation of the environmental audio signal and the frequency response of the third LTI system to determine the residual noise characteristic. The frequency-domain representation of the environmental audio signal may, for example, be obtained by conducting a Fourier transform on a time-domain representation of the environmental audio signal. In an alternative embodiment, the noise characteristics estimator may determine a convolution of a time-domain representation of the environmental audio signal and the impulse response of the third LTI system.

A variety of approaches for identification of non-linear systems exist, e.g. Volterra series or Artificial Neural Networks (ANN) or Markov chains.

Figure 22:
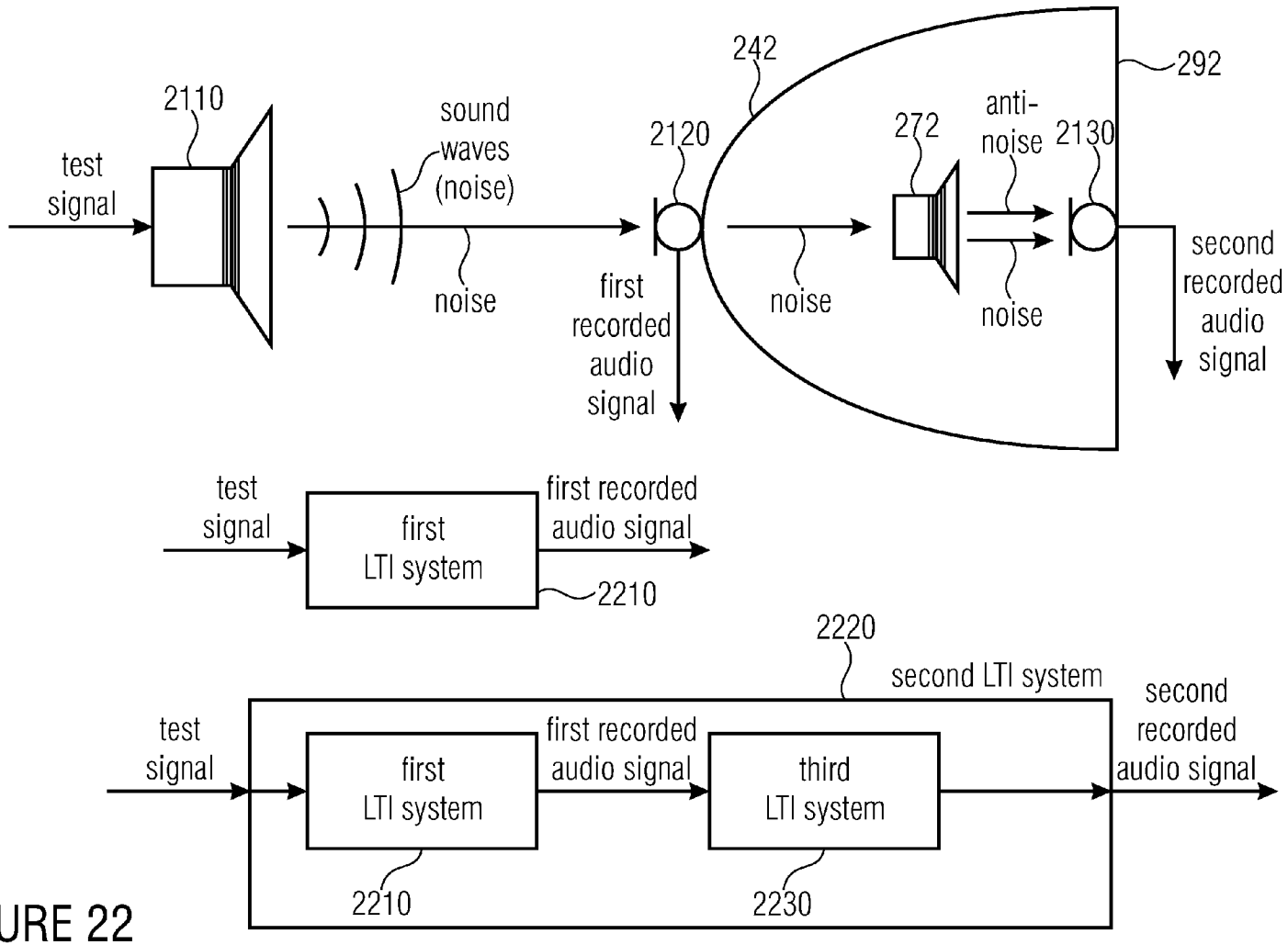
FIG. 22 illustrates modelled LTI systems corresponding to the test arrangement of FIG. 21 according to an embodiment.

For example, Artificial Neural Networks (ANN) may be trained by receiving the first recorded audio signal of FIG. 21 and FIG. 22 as an input signal and the second recorded audio signal of FIG. 21 and FIG. 22 as an output signal.

If the ANC is implemented in feedforward structure with only one microphone for sensing the primary noise, and since the anti-noise is known, the noise estimate can be derived from adding the noise and the anti-noise.

The spectral envelope is derived from the time signal of noise estimate the STFT (Short-Time Fourier Transform) or an alternative frequency transform or filter-bank. Using a regression method for approximating the transfer path, e.g. using ANN, the noise estimation can be implemented to directly estimate the spectral envelope, advantageously using features extracted from the noise measurement, e.g. obtained from the primary noise sensor, computed in the frequency domain.

The derived noise estimate is optionally post-processed by smoothing the trajectories of sub-band envelope signals, e.g. smoothing along the time axis, and by smoothing the spectral envelope, e.g. smoothing along the frequency axis.

In order not to compensate for semantically meaningful sound, e.g. speech and alarm sounds, and intelligent signal analysis is performed. The microphone signal is divided into the environmental noise which is compensated for and semantically meaningful sound which are excluded from noise estimate, either by applying a source separation processing or by detecting the presence of semantically meaningful sounds and manipulating the noise estimate in cases of positive detections.

In the latter case, the manipulation of the noise estimate is performed such that if sounds are detected which need to be presented to the listener the noise estimation is paused and thereby both PNC and ANC are disabled. The noise estimate is not updated in the microphone signals capture outside sounds which are not supposed to be compensated for.

Figure 18:
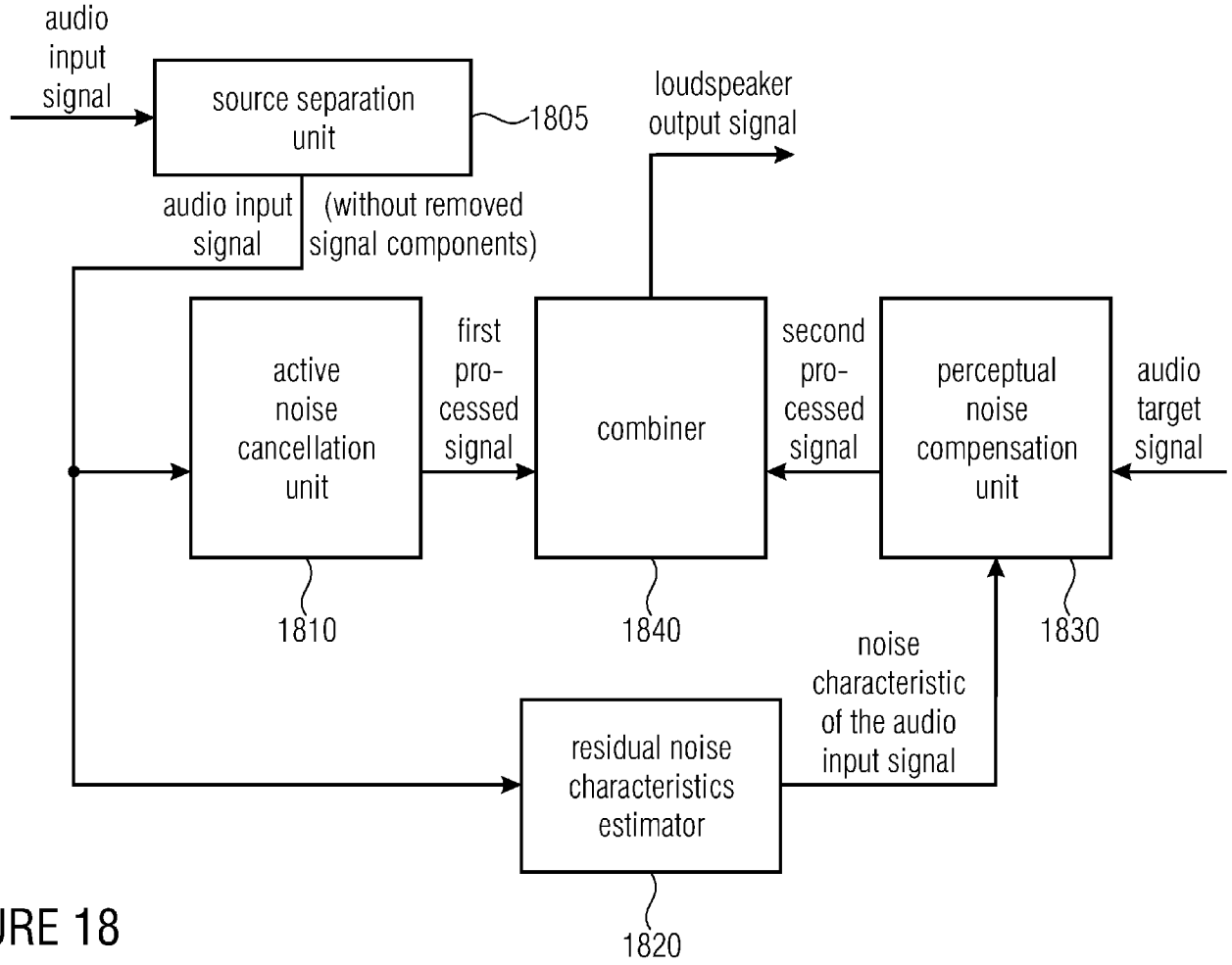
FIG. 18 is an apparatus for improving a perceived quality of sound reproduction according to a further embodiment, wherein the apparatus comprises a source separation unit.

FIG. 18 illustrates a corresponding apparatus according to an embodiment. The apparatus of the embodiment of FIG. 18 comprises an active noise cancellation unit 1810, a residual noise characteristics estimator 1820, a perceptual noise compensation unit 1830 and a combiner 1840, which may correspond to the active noise cancellation unit 110, the residual noise characteristics estimator 120, the perceptual noise compensation unit 130 and the combiner 140 of the embodiment of FIG. 1, respectively. The apparatus furthermore comprises a source separation unit 1805 which is configured to detect signal portions of the environmental audio signal which shall not be compensated. The source separation unit 1805 is moreover configured to remove the signal portions of the environmental audio signal which shall not be compensated from environmental audio signal.

Figure 19:
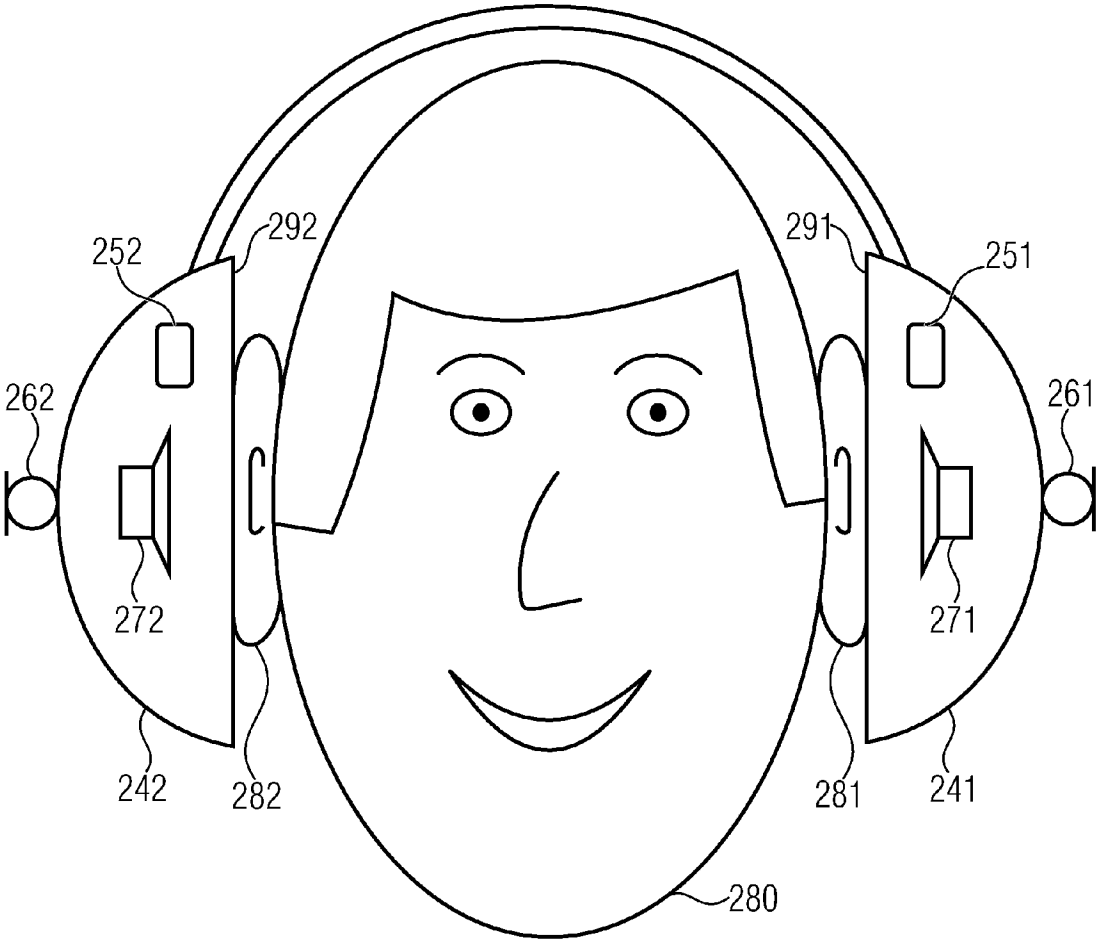
FIG. 19 illustrates a headphone according to an embodiment comprising two apparatuses for improving a perceived quality of sound reproduction according to the embodiment of FIG. 16.

FIG. 19 illustrates a headphone according to an embodiment comprising an apparatus for improving a perceived quality of sound reproduction according to the embodiment of FIG. 16. As in FIG. 2, the ear-cup 241 comprises a microphone 261 and an apparatus 251 for improving a perceived quality of sound reproduction. FIG. 19 moreover illustrates a loudspeaker 271 of the ear-cup 241. Reference sign 291 denotes an inner side 291 of the ear-cup 241. The inner side 291 of the ear-cup 241 is the side of the ear-cup that is in contact with an ear 281 of a listener 280 wearing the headphone as illustrated in FIG. 19. In the embodiment of FIG. 19, the microphone 261 is arranged such that the loudspeaker 271 of the ear-cup 241 is located between the microphone 261 and the inner side 291 of the ear-cup 241. Thus, the ear-cup 241 of FIG. 19 implements the feedforward structure of FIG. 16. Likewise, the ear-cup 242 comprises another apparatus 252 for improving a perceived quality of sound reproduction and another microphone 262 being arranged such that the loudspeaker 272 of the ear-cup 242 is located between the microphone 262 and an inner side 292 of the ear-cup 242. The inner side 292 of the ear-cup 242 is the side of the ear-cup 242 that is in contact with an ear 282 of a listener 280 wearing the headphone as illustrated in FIG. 19. Thus, the ear-cup 242 of FIG. 19 also implements the feedforward structure of FIG. 16.

Figure 20:
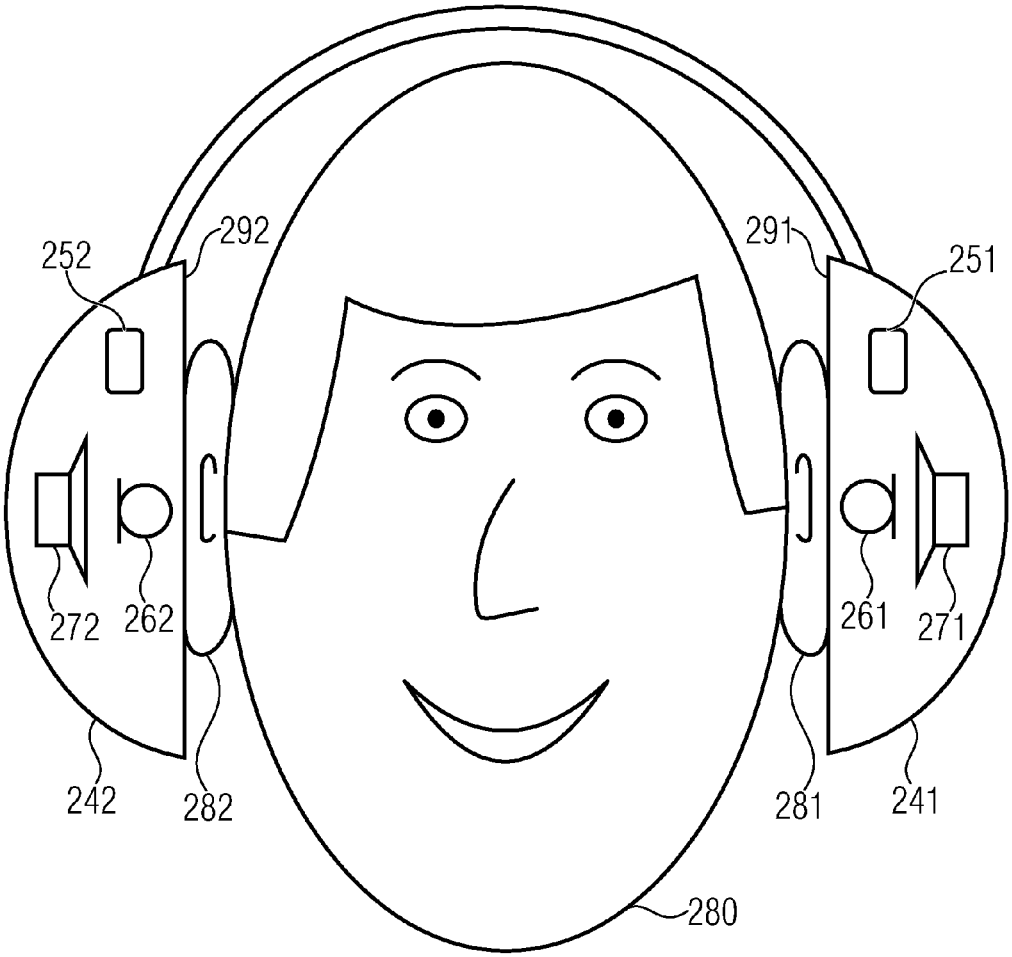
FIG. 20 illustrates a headphone according to an embodiment comprising a two apparatuses for improving a perceived quality of sound reproduction according to the embodiment of FIG. 17.

FIG. 20 illustrates a headphone according to an embodiment comprising an apparatus for improving a perceived quality of sound reproduction according to the embodiment of FIG. 17. As in FIG. 2, the ear-cup 241 comprises a microphone 261 and an apparatus 251 for improving a perceived quality of sound reproduction. FIG. 20 moreover illustrates a loudspeaker 271 of the ear-cup 241. Reference sign 291 denotes an inner side 291 of the ear-cup 241. The inner side 291 of the ear-cup 241 is the side of the ear-cup that is in contact with an ear 281 of a listener 280 wearing the headphone as illustrated in FIG. 20. In the embodiment of FIG. 20, the microphone 261 is arranged such that the microphone 261 of the ear-cup 241 is located between the loudspeaker 271 and the inner side 291 of the ear-cup 241. Thus, the ear-cup 241 of FIG. 20 implements the feedback structure of FIG. 17. Likewise, the ear-cup 242 comprises another apparatus 252 for improving a perceived quality of sound reproduction and another microphone 262 being arranged such that the microphone 262 of the ear-cup 242 is located between the loudspeaker 272 and an inner side 292 of the ear-cup 242. The inner side 292 of the ear-cup 242 is the side of the ear-cup 242 that is in contact with an ear 282 of a listener 280 wearing the headphone as illustrated in FIG. 20. Thus, the ear-cup 242 of FIG. 20 also implements the feedback structure of FIG. 17.

Figure 4:
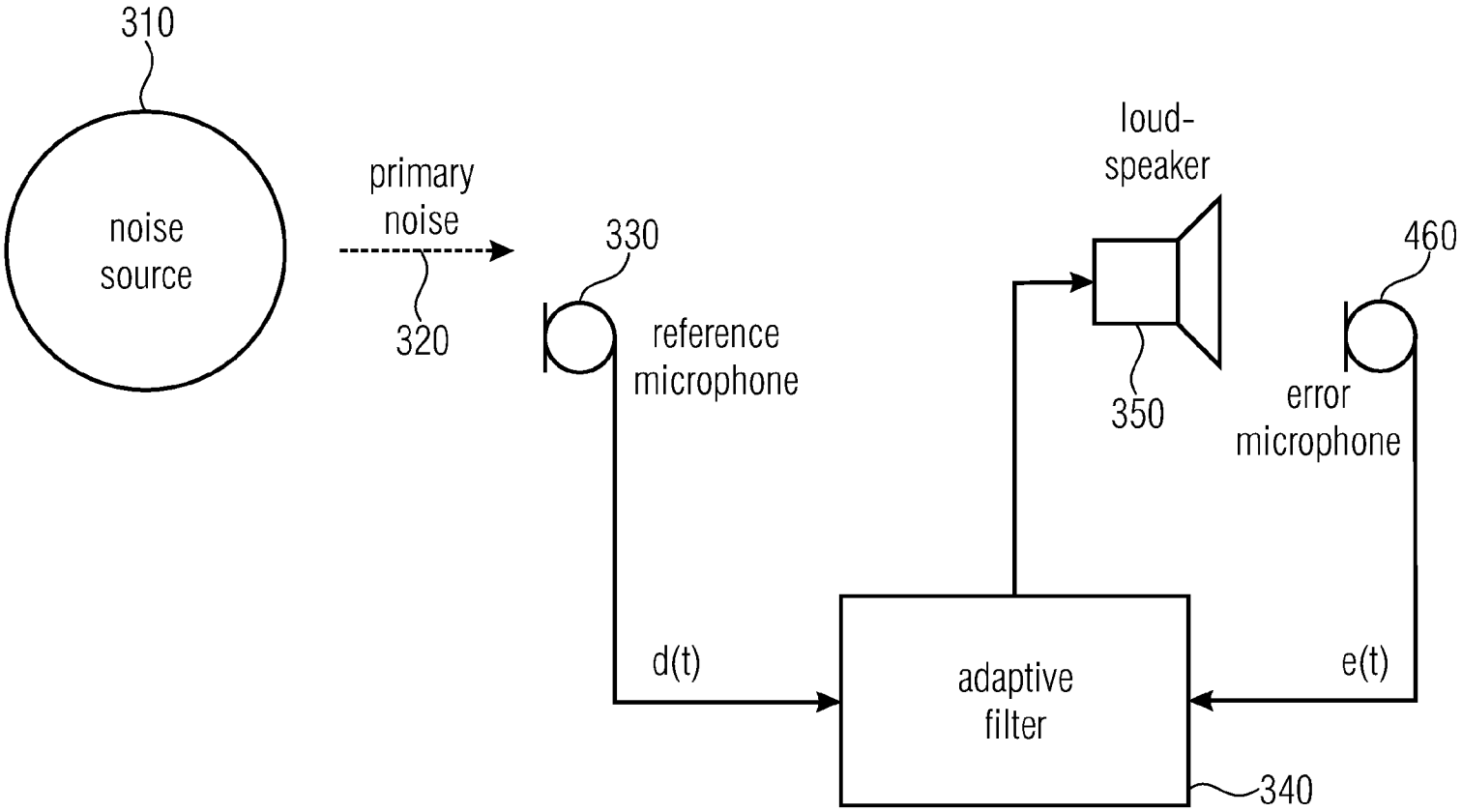
FIG. 4 is a block diagram of an active noise cancellation implementation with a feedforward structure with an additional error microphone
Figure 5:
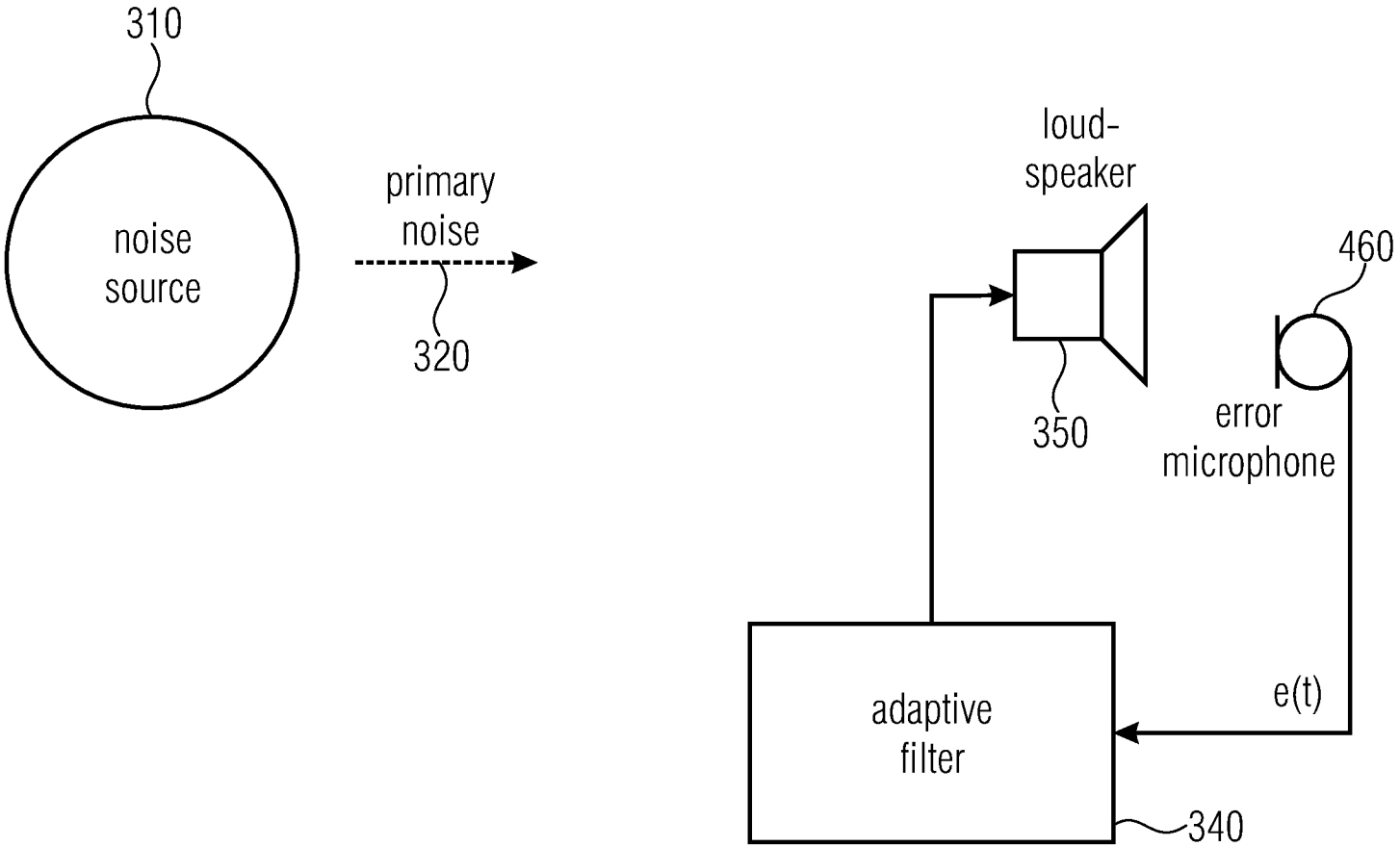
FIG. 5 is a block diagram of an active noise cancellation implementation with a feedback structure.
Figure 6:
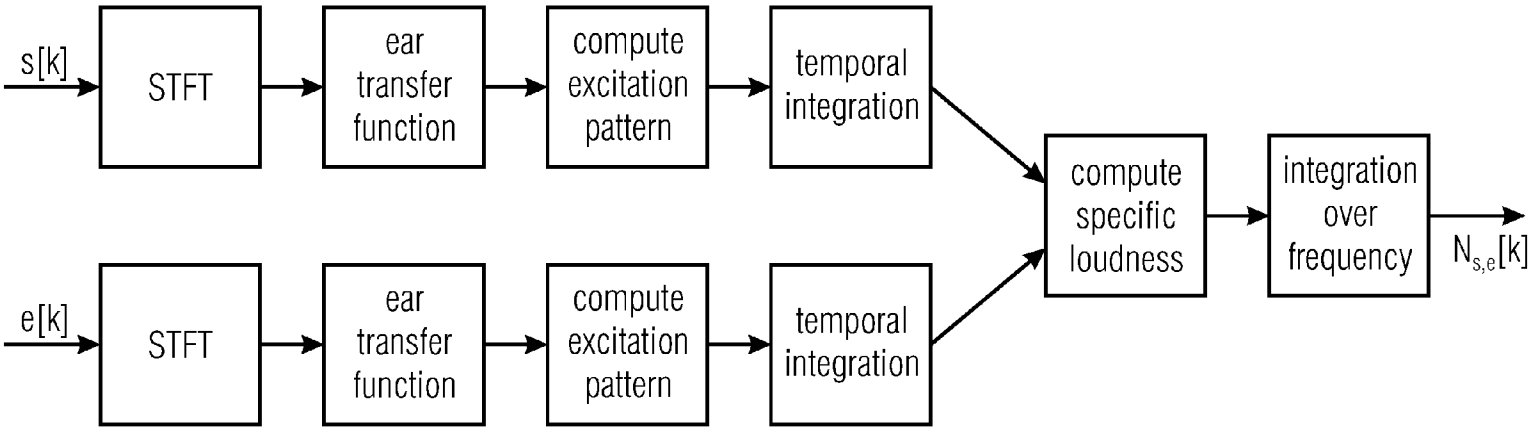
FIG. 6 is a block diagram of a perceptual model of partial loudness.
Figure 7:
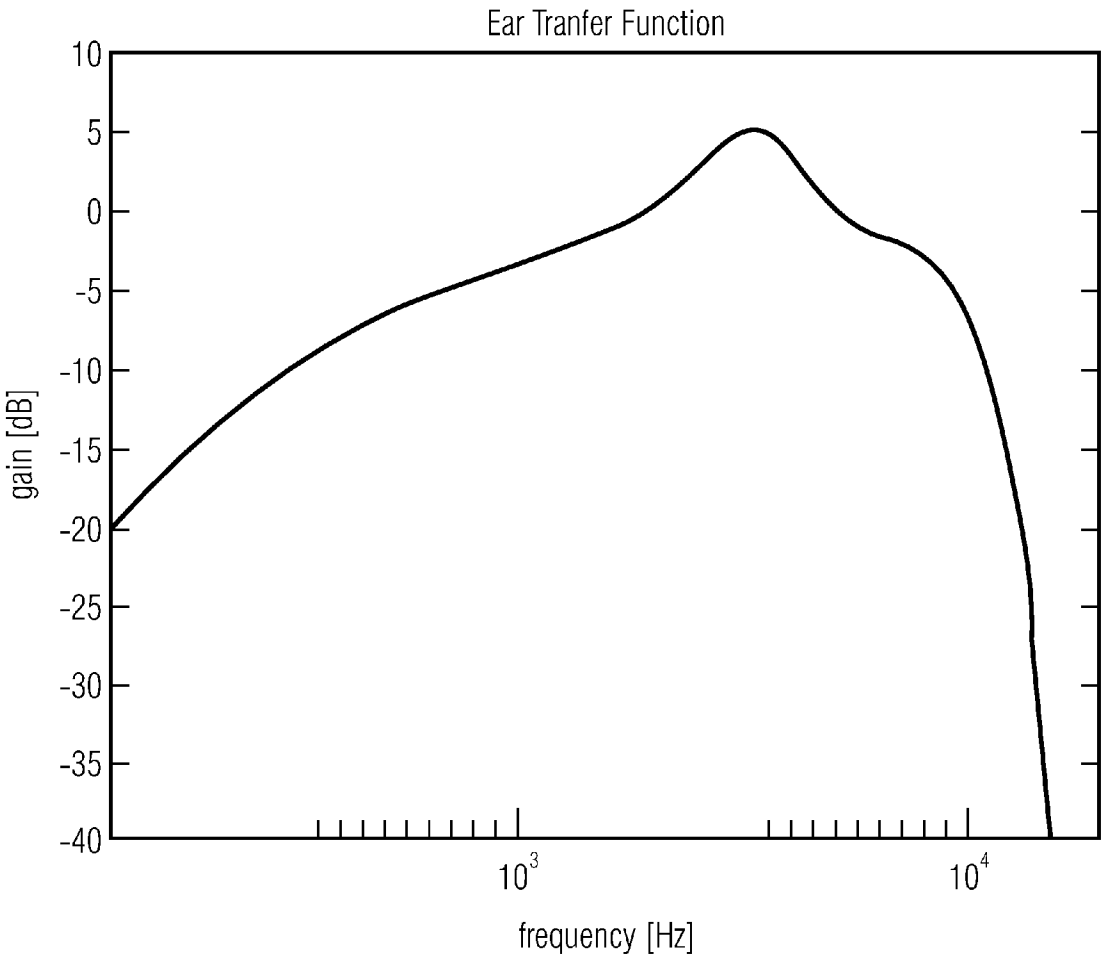
FIG. 7 is an example of a transfer function through the outer and middle ear.
Figure 8:
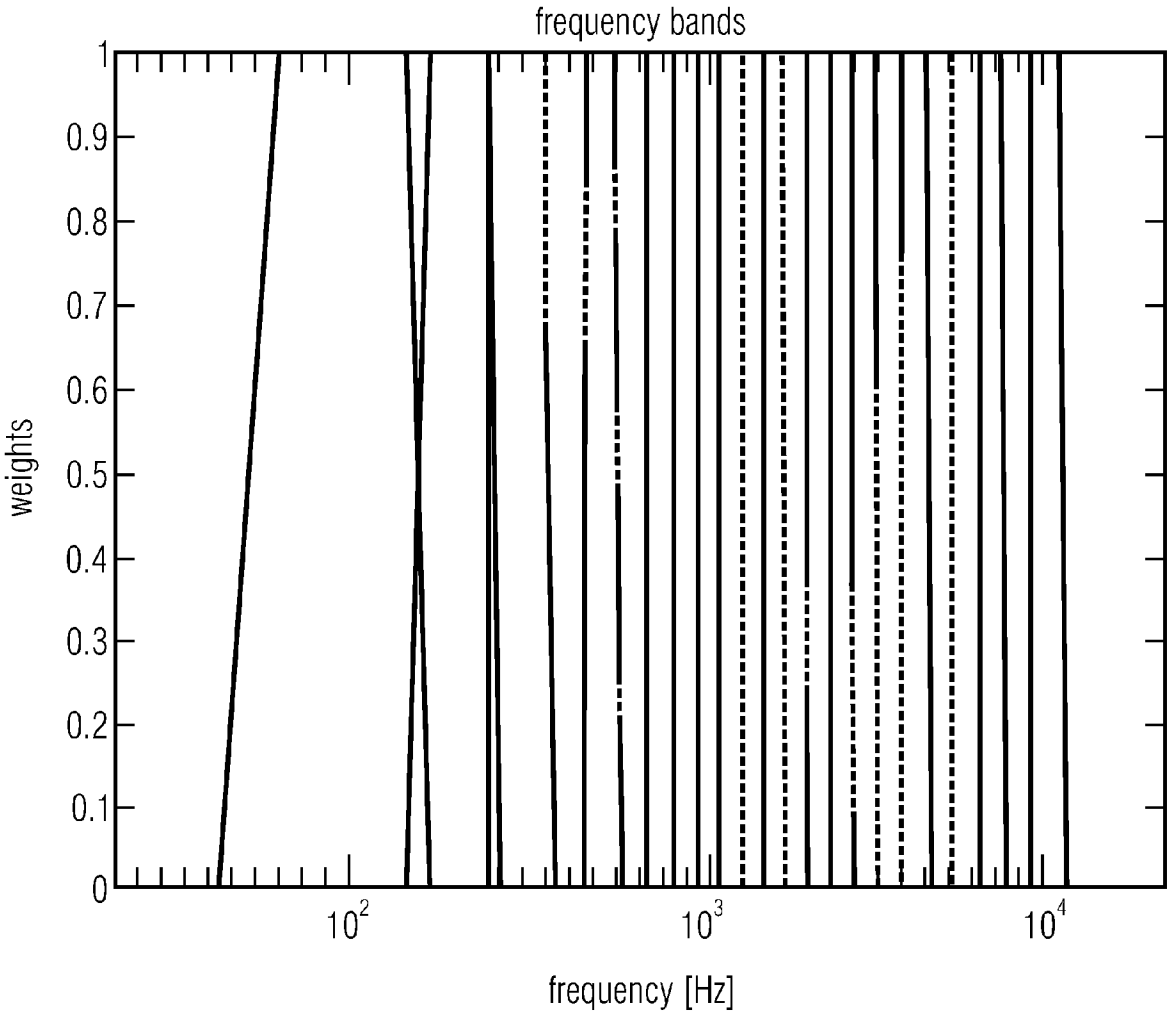
FIG. 8 is a simplified spacing of auditory filter bands, FIG. 9 are equal loudness contours.
Figure 9:
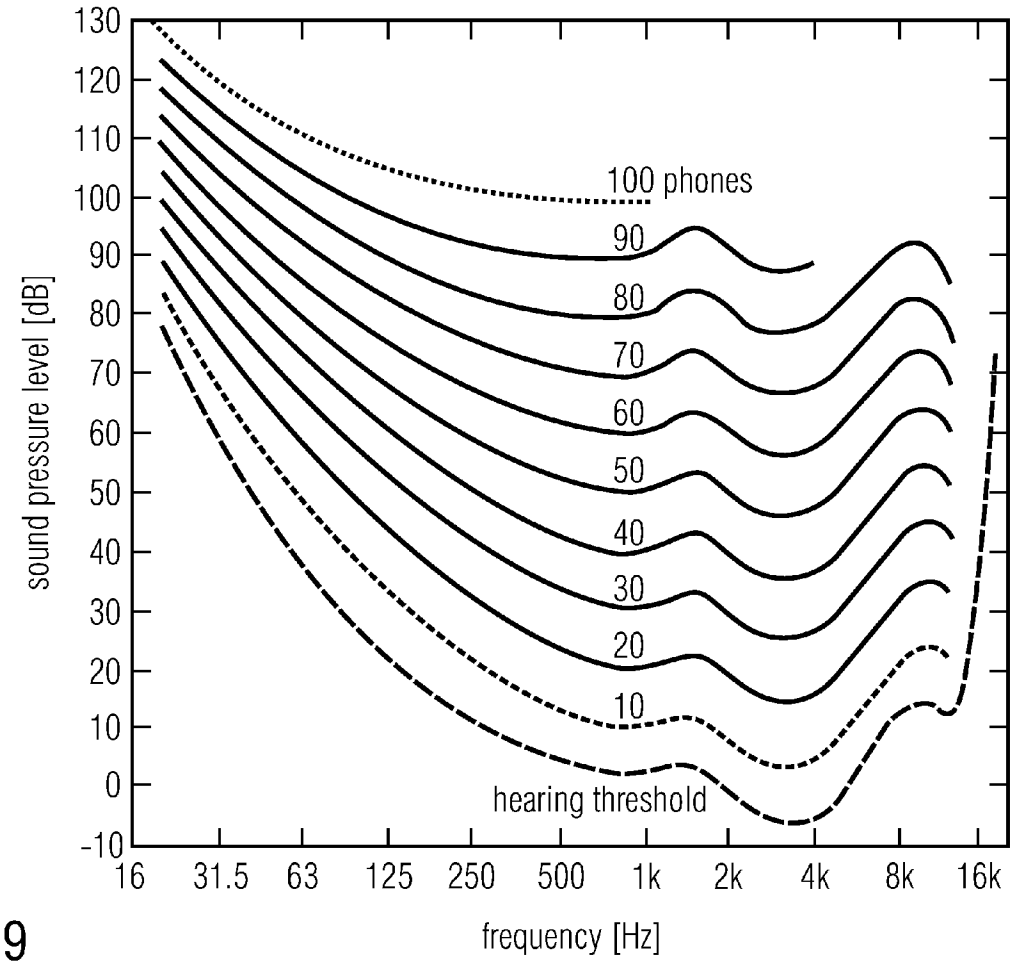
Figure 10:
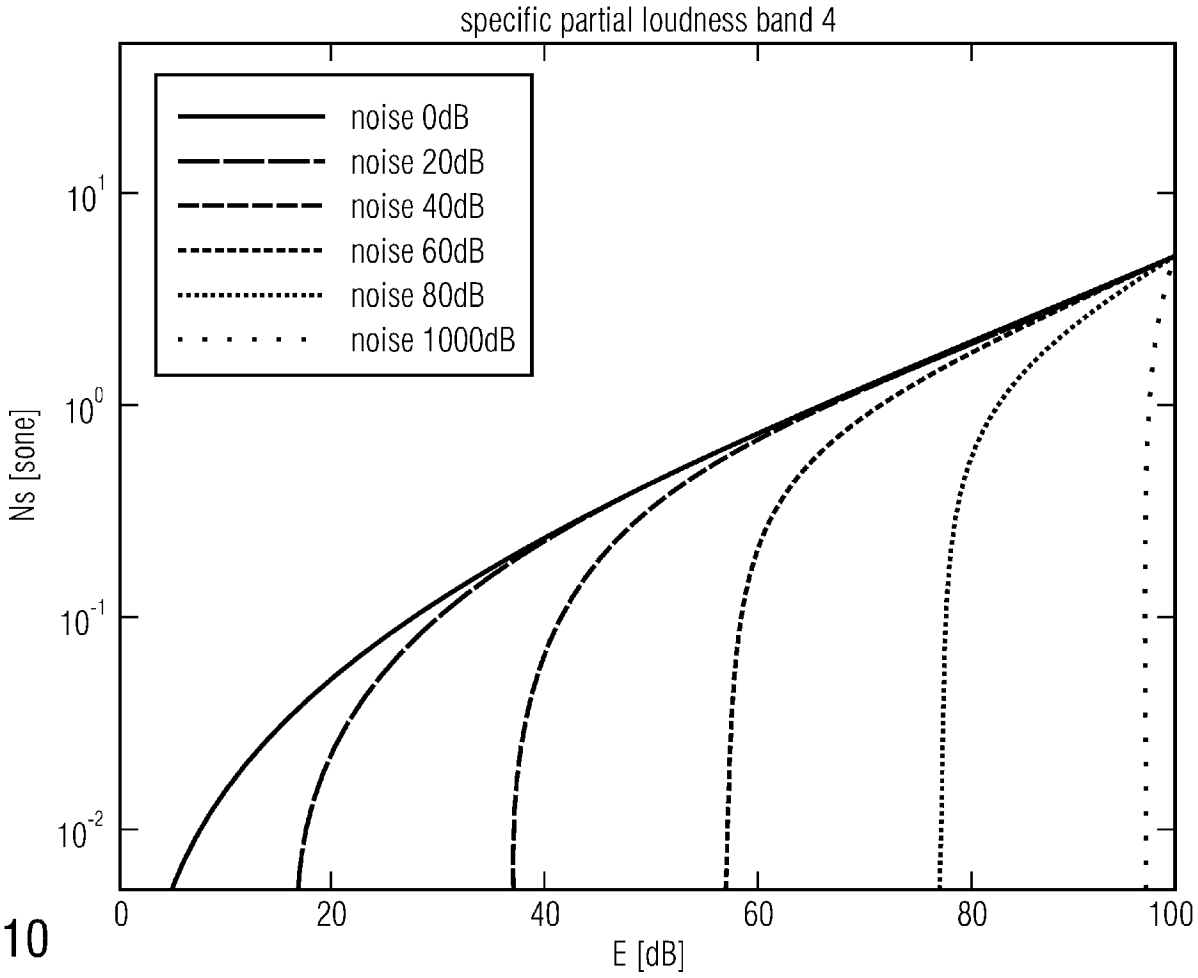
FIG. 10 is a specific partial loudness, exemplary for frequency band 4, and a function of noise excitation ranging from 0 to 100 dB.
Figure 11:
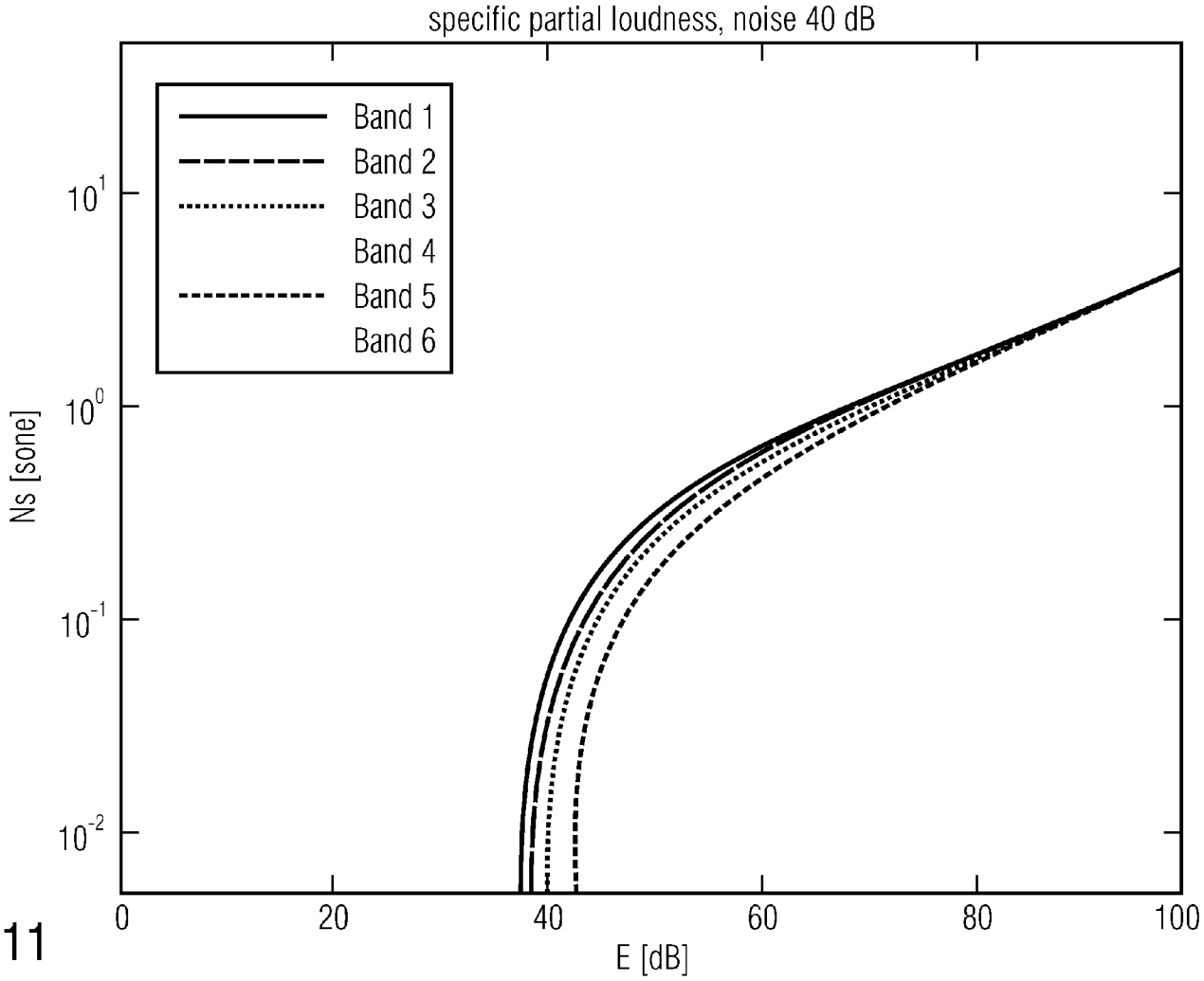
FIG. 11 is a specific partial loudness in noise with 40 dB noise excitation.

Headphones according to other embodiments may comprise more than two microphones, e.g., four microphones. For example, each ear-cup may comprise two microphones, one of them being a reference microphone and the other one being an additional error microphone, the additional error microphone being used for improving the ANC as mentioned in FIG. 4.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] S. J. Elliott and P. A. Nelson, "Active noise control," IEEE Signal Proc. Magazine, pp. 12-35, 1993

[2] S. M. Kuo and D. R. Morgan, "Active noise control: A tutorial review," Proc. of the IEEE, vol. 87, pp. 943-973, 1999

[3] E. Zwickler and K. Deuter, "U.S. Pat. No. 4,868,881: Method and system of background noise suppression in an audio circuit particularly for car radios," 1989.

[4] W. N. House, "Aspects of the vehicle listening environment," in Proc. of the AES 87$^{th}$ Conv., 1989

[5] M. Tzur and A. A. Goldin, "Sound equalization in a noisy environment," in Proc. of the 110$^{th}$ AES Conv., 2001.

[6] M. Christoph, "Dynamic sound control algorithms in automobiles," in Speech and Audio processing in Adverse Environments. Springer, 2008

[7] P. Lueg, "U.S. Pat. No. 2,043,416: Process of silencing sound oscillations," 1936.

[8] S. M. Kuo, S. Mitra, and W.-S. GAN, "Active noise control system for headphone applications," IEEE Trans. On Control Systems Technology, vol. 14, pp. 331-335, 2006.

[9] B. Sauert and P. Vary, "Near end listening enhancement: Speech intelligibility improvement in noisy environments," in Proc. of ICASSP, 2006.

[10] A. Seefeldt, "Loudness domain signal processing," in Proc. of the AES 123$^{rd}$ Convention, 2007.

[11] J. W. Shin and N. S. Kim, "Perceptual reinforcement of speech signal based on partial specific loudness," IEEE Signal Proc. Letters, vol. 14, pp. 887-890, 2007.

[12] B. C. J. Moore, B. R. Glasberg, and T. Baer, "A model for the prediction of thresholds, loudness and partial loudness,", J. Audio Eng. Soc., vol. 45, pp. 224-240, 1997

[13] B. R. Glasberg and B. C. J. Moore, "Development and evaluation of a model for predicting the audibility of time-varying sounds in the presence of background sounds," J. Audio Eng. Soc., vol. 53, pp. 906-918, 2005.

[14] E. Zwicker, H. Fastl, U. Widmann, K. Kurakata, S. Kuwano, and S. Namba, "Program for calculating loudness according to DIN 45631 (ISO 532b)," J. Acoust. Soc. Jpn, vol. 12, 1991.

[15] Y. Suzuki, "Precise and full-range determination of 2-dimensional equal loudness contours," Tech. Rep., AIST, 2003.

[16] T. Schneider, D. Coode, R. L. Brennan, and P. Olijnyk, "Sound intelligibility enhancement using a psychoacoustic model and an oversampled filterbank," 2006.

The invention claimed is:

1. An apparatus for improving a perceived quality of sound reproduction of an audio output signal, comprising:

an active noise cancellation unit for generating a noise cancellation signal using an environmental audio signal as an input, wherein the environmental audio signal comprises noise signal portions, the noise signal portions resulting from recording environmental noise, a residual noise characteristics estimator for determining a remaining noise estimate depending on the environmental noise and the noise cancellation signal, a perceptual noise compensation unit for generating a noise-compensated signal based on an audio target signal and the remaining noise estimate, and a combiner for combining the noise cancellation signal and the noise-compensated signal to acquire the audio output signal, wherein the residual noise characteristics estimator is arranged to receive the environmental audio signal, wherein the residual noise characteristics estimator is arranged to receive the noise cancellation signal from the active noise cancellation unit, and wherein the residual noise characteristics estimator is configured to determine the remaining noise estimate using the environmental audio signal and using the noise cancellation signal.

2. The apparatus according to claim 1, wherein the residual noise characteristics estimator is configured to determine the remaining noise estimate by adding the environmental audio signal and the noise cancellation signal.

3. The apparatus according to claim 1, wherein the apparatus furthermore comprises at least one loudspeaker and at least one microphone, wherein the microphone is configured to record the environmental audio signal, wherein the loudspeaker is configured to output the audio output signal, and wherein the microphone and the loudspeaker are arranged to implement a feedback structure.

4. The apparatus according to claim 1, wherein the apparatus furthermore comprises a source separation unit for detecting signal portions of the environmental audio signal which shall not be compensated.

5. The apparatus according to claim 4, wherein the source separation unit is configured to remove the signal portions of the environmental audio signal which shall not be compensated from the environmental audio signal.

6. A headphone comprising two ear-cups, wherein each of the ear-cups comprises:

an apparatus for improving a perceived quality of sound reproduction according to claim 1;

a loudspeaker, and at least one microphone for recording the environmental audio signal.

7. The headphone according to claim 6, wherein each of the loudspeakers of the ear-cups is arranged between one of the microphones of one of the ear-cups and an inner side of said ear-cup.

8. The headphone according to claim 7, wherein each of the microphones of the ear-cups is arranged between one of the loudspeakers of one of the ear-cups and an inner side of said ear-cup.

9. An apparatus for improving a perceived quality of sound reproduction of an audio output signal, comprising:

an active noise cancellation unit for generating a noise cancellation signal using an environmental audio signal as an input, wherein the environmental audio signal comprises noise signal portions, the noise signal portions resulting from recording environmental noise, a residual noise characteristics estimator for determining a remaining noise estimate depending on the environmental noise and the noise cancellation signal, a perceptual noise compensation unit for generating a noise-compensated signal based on an audio target signal and the remaining noise estimate, and a combiner for combining the noise cancellation signal and the noise-compensated signal to acquire the audio output signal, wherein the residual noise characteristics estimator is arranged to receive the environmental audio signal, wherein the residual noise characteristics estimator is arranged to receive the noise-compensated signal from the perceptual noise compensation unit, and wherein the residual noise characteristics estimator is configured to determine the remaining noise estimate based on the environmental audio signal and based on the noise-compensated signal, wherein the residual noise characteristics estimator is configured to determine the remaining noise estimate by subtracting scaled components of the noise-compensated signal from the environmental audio signal, and wherein the residual noise characteristics estimator is configured to determine the scaled components of the noise-compensated signal by scaling the received noise-compensated signal by a predetermined scale factor, wherein the predetermined scale factor indicates a signal level difference between an average signal level of an emitted signal when being emitted at a loudspeaker and an average signal level of the emitted signal when being recorded at a microphone.

10. The apparatus according to claim 9, wherein the apparatus furthermore comprises the loudspeaker and the microphone, wherein the microphone is configured to record the environmental audio signal, wherein the loudspeaker is configured to output the audio output signal, and wherein the microphone and the loudspeaker are arranged to implement a feedback structure.

11. The apparatus according to claim 9, wherein the apparatus furthermore comprises a source separation unit for detecting signal portions of the environmental audio signal which shall not be compensated.

12. The apparatus according to claim 11, wherein the source separation unit is configured to remove the signal portions of the environmental audio signal which shall not be compensated from the environmental audio signal.

13. A headphone comprising two ear-cups, wherein each of the ear-cups comprises:

an apparatus for improving a perceived quality of sound reproduction according to claim 9;

a loudspeaker, and at least one microphone for recording the environmental audio signal.

14. A method for improving a perceived quality of sound reproduction of an audio output signal, wherein the method comprises:

generating, by an active noise cancellation unit, a noise cancellation signal using an environmental audio signal as an input, wherein the environmental audio signal comprises noise signal portions, the noise signal portions resulting from recording environmental noise, determining, by a residual noise characteristics estimator, a remaining noise estimate depending on the environmental noise and the noise cancellation signal, generating, by a perceptual noise compensation unit, a noise-compensated signal based on an audio target signal and the remaining noise estimate, and combining, by a combiner, the noise cancellation signal and the noise-compensated signal to acquire the audio output signal, wherein the residual noise characteristics estimator receives the environmental audio signal, wherein the residual noise characteristics estimator receives the noise cancellation signal from the active noise cancellation unit, and wherein the residual noise characteristics estimator determines the remaining noise estimate using the environmental audio signal and using the noise cancellation signal.

15. A non-transitory computer readable medium including a computer program for implementing the method of claim 14 when being executed on a computer or signal processor.

16. A method for improving a perceived quality of sound reproduction of an audio output signal, comprising:

generating a noise cancellation signal using an environmental audio signal as an input, wherein the environmental audio signal comprises noise signal portions, the noise signal portions resulting from recording environmental noise, determining a remaining noise estimate depending on the environmental noise and the noise cancellation signal, generating a noise-compensated signal based on an audio target signal and the remaining noise estimate, and combining the noise cancellation signal and the noise-compensated signal to acquire the audio output signal, wherein determining the remaining noise estimate is conducted based on the environmental audio signal and based on the noise-compensated signal, wherein determining the remaining noise estimate by subtracting scaled components of the noise-compensated signal from the environmental audio signal, and wherein determining the scaled components of the noise-compensated signal is conducted by scaling the received noise-compensated signal by a predetermined scale factor, wherein the predetermined scale factor indicates a signal level difference between an average signal level of an emitted signal when being emitted at the loudspeaker and an average signal level of the emitted signal when being recorded at the microphone.

17. A non-transitory computer readable medium including a computer program for implementing the method of claim 16 when being executed on a computer or signal processor.

* * * * *